US011590386B2

(12) United States Patent
Barragan

(10) Patent No.: US 11,590,386 B2
(45) **Date of Patent: *Feb. 28, 2023**

(54) EXERCISE SYSTEM AND METHOD

(71) Applicant: Carlos Barragan, West Covina, CA (US)

(72) Inventor: Carlos Barragan, West Covina, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/569,552

(22) Filed: Jan. 6, 2022

(65) Prior Publication Data

US 2022/0176194 A1 Jun. 9, 2022

Related U.S. Application Data

(63) Continuation of application No. 17/543,074, filed on Dec. 6, 2021.

(Continued)

(51) Int. Cl.

| | |
|---|---|
| ***A63B 21/00*** | (2006.01) |
| ***A63B 23/02*** | (2006.01) |
| ***A63B 23/035*** | (2006.01) |

(52) U.S. Cl.

CPC ..... *A63B 21/4045* (2015.10); *A63B 21/4035* (2015.10); *A63B 23/0222* (2013.01); *A63B 23/03525* (2013.01)

(58) Field of Classification Search

CPC ..... A63B 21/00058; A63B 21/00065; A63B 21/00069; A63B 21/062; A63B 21/0626;

(Continued)

(56) References Cited

U.S. PATENT DOCUMENTS 3,589,720 A * 6/1971 Agamian ..... A63B 22/203 482/114
4,627,615 A * 12/1986 Nurkowski ..... A63B 21/0628 482/99
5,417,630 A * 5/1995 Schultz ..... A63B 69/182 482/93

(Continued)

FOREIGN PATENT DOCUMENTS

WO 2020/156723 A1 8/2020

OTHER PUBLICATIONS

Written Opinion of the International Searching Authority dated Feb. 17, 2022.

*Primary Examiner* — Gary D Urbiel Goldner

(74) *Attorney, Agent, or Firm* — Jacob M. Ward; Ward Law Office LLC

(57) ABSTRACT

An exercise system includes a frame, an upper body carriage, a lower body carriage, a positioning carriage, a resistance assembly attached to the frame, and a connecting mechanism. The frame includes a right guide rail, a left guide rail, and a central guide rail disposed between the right guide rail and the left guide rail. The upper body carriage includes an upper right and an upper left carriage slidingly attached to the right and left guide rail, respectively. The lower body carriage includes a lower right and lower left carriage slidingly attached to the right and left guide rail, respectively. The connecting mechanism mechanically couples one of the upper body carriage, the lower body carriage, or the positioning carriage to the resistance assembly such that the resistance assembly applies a predetermined level of resistive force to the upper body carriage, the lower body carriage, and/or the positioning carriage.

11 Claims, 12 Drawing Sheets

Related U.S. Application Data

(60) Provisional application No. 63/205,632, filed on Dec. 4, 2020.

(58) Field of Classification Search
CPC ..... A63B 21/0628; A63B 21/063; A63B 21/0632; A63B 21/15; A63B 21/151; A63B 21/152; A63B 21/154; A63B 21/4027; A63B 21/4029; A63B 21/4031; A63B 21/4033; A63B 21/4034; A63B 21/4035; A63B 21/4039; A63B 21/4045; A63B 22/0076; A63B 22/0087; A63B 22/0089; A63B 22/20; A63B 22/201; A63B 22/203; A63B 23/02; A63B 23/0205; A63B 23/0222; A63B 23/035; A63B 23/03516; A63B 23/03525; A63B 23/03575; A63B 23/04; A63B 23/0405; A63B 23/047; A63B 23/12; A63B 23/1209; A63B 69/06; A63B 2208/0214; A63B 2208/0219
See application file for complete search history.

(56) References Cited

U.S. PATENT DOCUMENTS

| | | | | |
|---|---|---|---|---|
| 5,518,483 | A | 5/1996 | Oswald | |
| 6,569,064 | B1 * | 5/2003 | Loane | A63B 21/154 482/146 |
| 7,780,585 | B1 | 8/2010 | Rivas | |
| 10,806,985 | B1 * | 10/2020 | Loane | A63B 22/201 |
| 2003/0054926 | A1 * | 3/2003 | Toole | A63B 21/0626 482/123 |
| 2004/0014569 | A1 * | 1/2004 | Loane | A63B 21/4007 482/70 |
| 2005/0148446 | A1 * | 7/2005 | Sencil | A63B 21/0628 482/100 |
| 2006/0223681 | A1 * | 10/2006 | Loane | A63B 22/16 482/71 |
| 2009/0298657 | A1 * | 12/2009 | Potok | A63B 23/1245 482/141 |
| 2014/0011645 | A1 | 1/2014 | Johnson et al. | |
| 2014/0031175 | A1 * | 1/2014 | Peralo | A63B 21/4045 482/66 |
| 2019/0160325 | A1 * | 5/2019 | Latronica | A63B 22/0061 |

* cited by examiner

EXERCISE SYSTEM AND METHOD

CROSS-REFERENCE TO RELATED APPLICATIONS

This application is a continuation of U.S. Nonprovisional Application Ser. No. 17/543,074, filed on Dec. 6, 2021, which claims priority to and the benefit of U.S. Provisional Application No. 63/205,632, filed on Dec. 4, 2020. The entire disclosures of the above applications are hereby incorporated herein by reference.

FIELD

The present disclosure relates to exercise systems, and more particularly, to exercise systems that target multiple muscle groups

BACKGROUND

The statements in this section merely provide background information related to the present disclosure and may not constitute prior art.

Traditional abdominal exercises are limited to conventional crunches and sit-ups, which involves starting in a supine position, moving upward by curling the torso until in a crunch or sit-up position, and returning to the supine position. However, curving the spine against the ground can cause injury to the hip flexor muscles, which can cause injury to the spine and back. Another challenge with traditional crunches and sit-ups is maintaining proper form. When performed improperly, increased strain is put on the neck, which leads to further injuries.

Additionally, traditional crunches and sit-ups only target the abdominal muscles. In contrast, exercises involving planks are safer, target more muscles across the entire core, and engage more muscles, such as shoulder muscles, latissimus dorsi muscles, quadricep muscles, and gluteal muscles.

There is a continuing need for an exercise system that allows the user to maintain proper form for targeting abdominal muscles, deltoid muscles, triceps muscles, latissimus dorsi muscles, quadricep muscles, pectoralis muscles, and gluteal muscles while incorporating resistance for increased strength training thereby reducing chances of injury and strain.

SUMMARY

In concordance with the instant disclosure, an exercise system that allows a user to perform various exercises, such as moving from an extended position to a crunch position that targets and engages the abdominal muscles, deltoid muscles, triceps muscles, latissimus dorsi muscles, quadricep muscles, pectoralis muscles, and/or gluteal muscles, that improves grip, flexibility, balance, and posture, and that reduces muscle pain while incorporating resistance and maintaining proper form, is surprisingly discovered.

In one embodiment, an exercise system includes a frame, an upper body carriage, a lower body carriage, a positioning carriage, a resistance assembly attached to the frame, and a connecting mechanism configured to mechanically couple at least one of the upper body carriage, the lower body carriage, and the carriage to the resistance assembly such that the resistance assembly applies a predetermined level of resistive force to at least one of the upper body carriage, the lower body carriage, and the positioning carriage. The frame includes a right guide rail, a left guide rail, and a central guide rail configured to be disposed between the right guide rail and the left guide rail. The upper body carriage includes an upper right carriage configured to be slidingly attached to the right guide rail and an upper left carriage configured to be slidingly attached to the left guide rail. The lower body carriage includes a lower right carriage configured to be slidingly attached to the right guide rail and a lower left carriage configured to be slidingly attached to the left guide rail.

In one example, the upper body carriage and the carriage can be configured to lock together such that the upper body carriage and the carriage simultaneously translate between a forward direction and a rearward direction.

In another example, the lower body carriage and the carriage can be configured to lock together such that the lower body carriage and the carriage simultaneously translate between a forward direction and a rearward direction.

In various other examples, the upper body carriage can include an attachment plate configured to attach the upper right carriage to the upper left carriage. The lower body carriage can include an attachment plate configured to attach the lower right carriage to the lower left carriage. The upper body carriage can include a pair of vertical handles and a pair of horizontal handles. The frame can include a vertical member and the resistance assembly is attached to the vertical member. The upper body carriage can include a top support slidingly attached to the upper body carriage and the upper right carriage and the upper left carriage are attached to the top support. The exercise system can include a display screen including physiological sensors. The upper body carriage can include a lower right extremity support pivotably secured to the upper right carriage and a lower left extremity support pivotably secured to the upper left carriage.

In another example, the upper body carriage includes a lower right extremity support secured to the upper right carriage and a lower left extremity support secured to the upper left carriage, and the lower body carriage can include a right side support secured to the lower right carriage and a left side support secured to the lower left carriage.

In another embodiment, an exercise system includes a frame including a guide rail having a first end and a second end, and at least one carriage configured to be slidingly engaged with the guide rail to translate in a reciprocating motion relative to the first end and the second end of the guide rail, the at least one carriage can include an upper body carriage and a lower body carriage. An upper body support can be secured to the upper body carriage and a lower body support can be secured to the lower body carriage. A resistance assembly can be attached to the frame, and a connecting mechanism is provided to mechanically couple the at least one carriage to the resistance assembly such that the resistance assembly applies a predetermined level of resistive force to the at least one carriage In one example, the at least one carriage can include a carriage configured to be secured to the upper body carriage or the lower body carriage and the connecting mechanism mechanically couples the carriage to the resistance assembly.

In other various examples, the at least one carriage can include a pair of vertical handles adapted to pivot about a horizontal pivot axis for angular orientation adjustment, the upper body carriage can include an upper body support and the lower body carriage includes a lower body support, and/or each one of the upper body carriage and the lower body carriage can include a lock mechanism configured to selectively secure the upper body carriage and the lower body carriage to the guide rail.

In further examples, the resistance assembly can include a weight stack, a hydraulic piston, a flywheel, or a resistance band. The upper body carriage can include a pair of vertical handles and/or horizontal handles.

In another embodiment, a method of performing an exercise to activate multiple muscle groups of an exerciser is provided. The method includes placing a portion of an upper body of the exerciser on an upper body support surface such that a right elbow is aligned with and beneath a right shoulder and a left elbow is aligned with and beneath a left shoulder. The portion of the upper body can include a portion of a right arm and a portion of a left arm. Next, the exerciser places a portion of the lower body on a lower body support surface such that the exerciser is face down with a flat back drawing obliques in and navel towards a spine. Once the upper body and lower body of the exerciser is positioned, the exerciser translates the portion of the upper body and/or the portion of the lower body in a reciprocating motion between a forward direction and a rearward direction such that a plurality of muscle groups of the user are activated. The plurality of muscle groups can be selected from the group consisting of abdominal muscles, deltoid muscles, triceps muscles, latissimus dorsi muscles, quadricep muscles, pectoralis muscles, and gluteal muscles.

In one example, the method includes providing a frame including a guide rail having a first end and a second end and providing an upper body carriage and a lower body carriage, wherein each one of the upper body carriage and the lower body carriage configured to be slidingly engaged with the guide rail to translate in a reciprocating motion relative to the first end and the second end of the guide rail. The method further includes providing an upper body support secured to the upper body carriage and defining the upper body support surface, providing a lower body support secured to the lower body carriage and defining the lower body support surface, providing a resistance assembly attached to the frame, and providing a connecting mechanism configured to mechanically couple the upper body carriage and/or the lower body carriage to the resistance assembly such that the resistance assembly applies a predetermined level of resistive force to the upper body carriage and/or the lower body carriage. A portion of the upper body is placed on the upper body support surface of the upper body carriage and the portion of the lower body is placed on the lower body support surface of the lower body carriage. The portion of the upper body translates in a reciprocating motion between the forward direction and the rearward direction via the upper body carriage and the portion of the lower body translates in a reciprocating motion between the forward direction and the rearward direction via the lower body carriage.

In another example, the method further includes gripping a pair of vertical handles or a pair of horizontal handles.

In another embodiment, a plank exercise system is provided that includes a full lower arm rest support to support the elbow, forearm, and/or wrist that allows you start the exercise in a traditional plank position and roll back into an abdominal roll crunch.

In one example, the plank exercise system can include a display monitor measuring heart beats per minute, time, calorie burned, resistance level, lap or meter distance, miles, and any other traditional monitoring measurements. The user's lower body can be supported while the knees are resting on a knee lower leg cushion with knee brace while having the upper arms supported on an elbow, forearm, or wrist support slider which can include hand grips for the user to grip. The upper body and lower arms allows the user to glide on the elbow, forearm, or wrist support slider within the rail or track that is supported on wheels, rollers, linear pillow top bearings, square tube bearing or any other rotation supports.

In another example, the user can flex from a traditional plank position to an abdominal crunch position thereby exercising in a forward and backward motion doing multiple repetitions. The plank exercise system can include different types of tensions and is not limited to gymnasium weights, a pulley device, adjustable hydraulic piston, tension Pilate straps/bands, adjustable skid wheel pad resistance, adjustable magnetic tensioner, air resistance, air/magnetic resistance, water resistance, or strap resistance.

In other various examples, the plank exercise system can be scaled in size and incorporate a multi-station functional gym equipment using heavy duty weights with traditional gym weights. The plank exercise system can be scaled for at home use incorporating lighter smaller weights and resistance. The plank exercise system can be scaled to allow for easy storage when not in use. Once scaled, the plank exercise system can include a storage device to store band tensioners having different resistant strengths. The plank exercise system can include a dual weight stack or a single weight stack. The plank exercise system can have levels of resistance that can be pre-selected or adjusted by the user to accommodate varying resistance levels. The plank exercise system can include multiple adjustment settings to accommodate of varying heights. The elbow, forearm, or wrist support slider can include an adjustable wheel position carriage that includes a pop pin configured to move forward or backward on the track depending on a user's desired starting position. The elbow, forearm, or wrist support slider can include a plurality pop pin adjustors for a user's desired positioning. The plank exercise system can include adjustable handles having multiple positions. The plank exercise system can include a quick release locking mechanism to pull a tension load bearing carriage. The plank exercise system can include Bluetooth or streaming capabilities to follow application based, virtual, live, or prerecorded class training videos.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
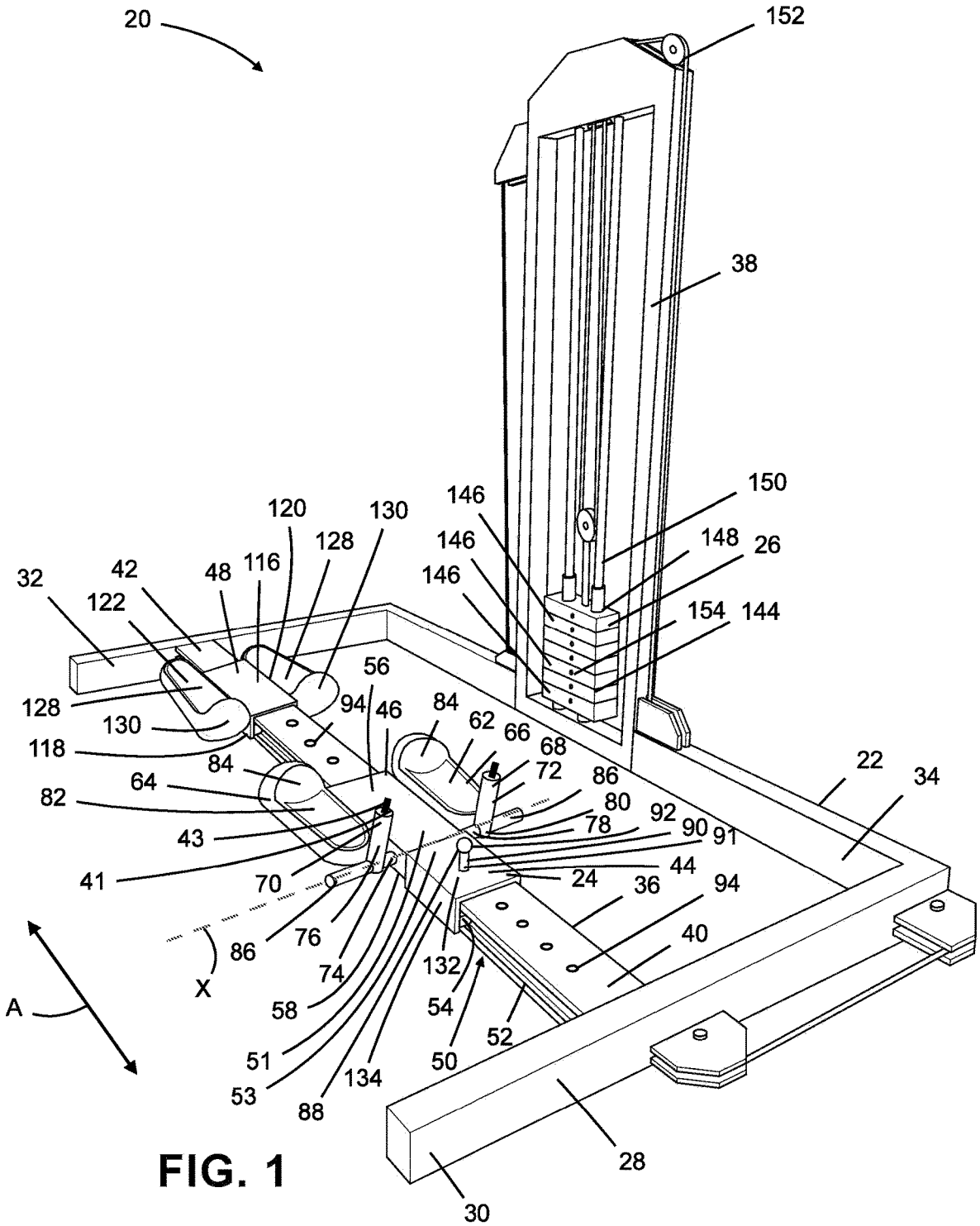
FIG. 1 is a perspective view of an exercise device according to an embodiment of the present disclosure.

The following description of technology is merely exemplary in nature of the subject matter, manufacture, and use of one or more inventions, and is not intended to limit the scope, application, or uses of any specific invention claimed in this application or in such other applications as can be filed claiming priority to this application, or patents issuing therefrom. Regarding methods disclosed, the order of the steps presented is exemplary in nature, and thus, the order of the steps can be different in various embodiments, including where certain steps can be simultaneously performed.

The terms "a" and "an" as used herein indicate "at least one" of the item is present; a plurality of such items can be present, when possible. Except where otherwise expressly indicated, all numerical quantities in this description are to be understood as modified by the word "about" and all geometric and spatial descriptors are to be understood as modified by the word "substantially" in describing the broadest scope of the technology. The term "about" when applied to numerical values indicates that the calculation or the measurement allows some slight imprecision in the value (with some approach to exactness in the value; approximately or reasonably close to the value; nearly). If, for some reason, the imprecision provided by "about" and/or "substantially" is not otherwise understood in the art with this ordinary meaning, then "about" and/or "substantially" as used herein indicates at least variations that can arise from ordinary methods of measuring or using such parameters.

Although the open-ended term "comprising," as a synonym of non-restrictive terms such as including, containing, or having, is used herein to describe and claim embodiments of the present technology, embodiments can alternatively be described using more limiting terms such as "consisting of" or "consisting essentially of." Thus, for any given embodiment reciting materials, components, or process steps, the present technology also specifically includes embodiments consisting of, or consisting essentially of, such materials, components, or process steps excluding additional materials, components or processes (for consisting of) and excluding additional materials, components or processes affecting the significant properties of the embodiment (for consisting essentially of), even though such additional materials, components or processes are not explicitly recited in this application.

Disclosures of ranges are, unless specified otherwise, inclusive of endpoints and include all distinct values and further divided ranges within the entire range. Thus, for example, a range of "from A to B" or "from about A to about B" is inclusive of A and of B. Disclosure of values and ranges of values for specific parameters (such as amounts, weight percentages, etc.) are not exclusive of other values and ranges of values useful herein. It is envisioned that two or more specific exemplified values for a given parameter can define endpoints for a range of values that can be claimed for the parameter. For example, if Parameter X is exemplified herein to have value A and also exemplified to have value Z, it is envisioned that Parameter X can have a range of values from about A to about Z. Similarly, it is envisioned that disclosure of two or more ranges of values for a parameter (whether such ranges are nested, overlapping, or distinct) subsume all possible combination of ranges for the value that might be claimed using endpoints of the disclosed ranges. For example, if Parameter X is exemplified herein to have values in the range of 1-10, or 2-9, or 3-8, it is also envisioned that Parameter X can have other ranges of values including 1-9, 1-8, 1-3, 1-2, 2-10, 2-8, 2-3, 3-10, 3-9, and so on.

When an element or layer is referred to as being "on," "engaged to," "connected to," or "coupled to" another element or layer, it can be directly on, engaged, connected, or coupled to the other element or layer, or intervening elements or layers can be present. In contrast, when an element is referred to as being "directly on," "directly engaged to," "directly connected to" or "directly coupled to" another element or layer, there can be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. can be used herein to describe various elements, components, regions, layers and/or sections, these elements, components, regions, layers and/or sections should not be limited by these terms. These terms can be only used to distinguish one element, component, region, layer or section from another region, layer, or section. Terms such as "first," "second," and other numerical terms when used herein do not imply a sequence or order unless clearly indicated by the context. Thus, a first element, component, region, layer, or section discussed below could be termed a second element, component, region, layer, or section without departing from the teachings of the example embodiments.

Spatially relative terms, such as "inner," "outer," "beneath," "below," "lower," "above," "upper," and the like, can be used herein for ease of description to describe one element or feature's relationship to another element(s) or feature(s) as illustrated in the figures. Spatially relative terms can be intended to encompass different orientations of the device in use or operation in addition to the orientation depicted in the figures. For example, if the device in the figures is turned over, elements described as "below", or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Figure 2:
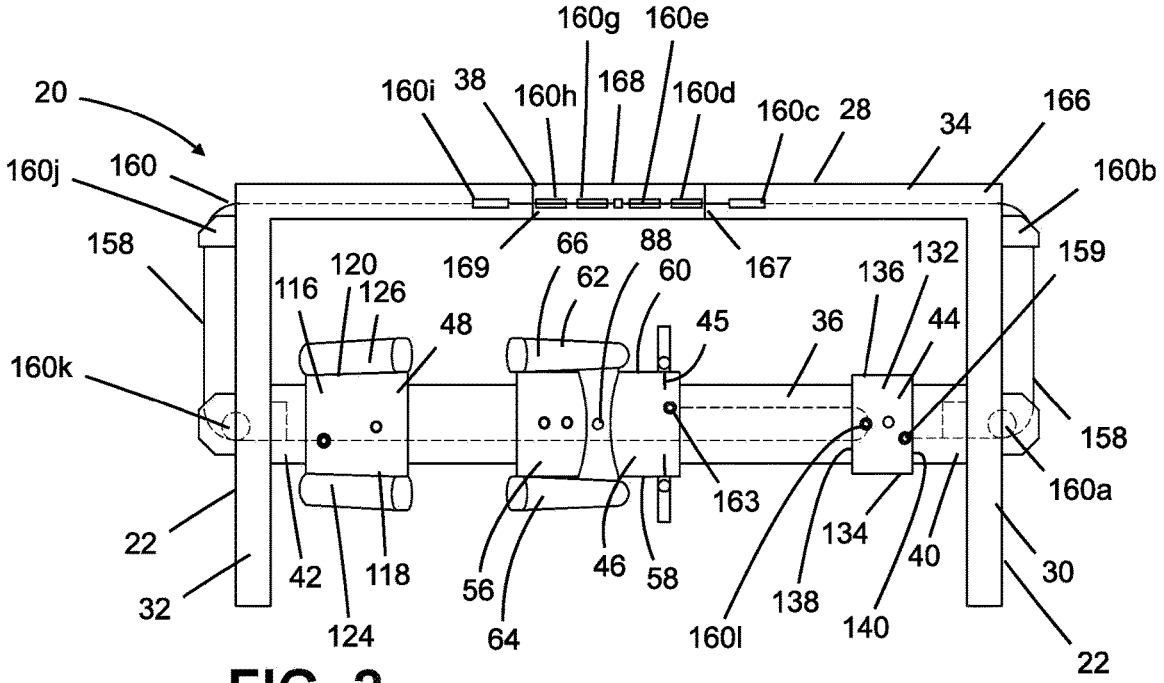
FIG. 2 is a top plan view of the exercise device of FIG. 1.
Figure 3:
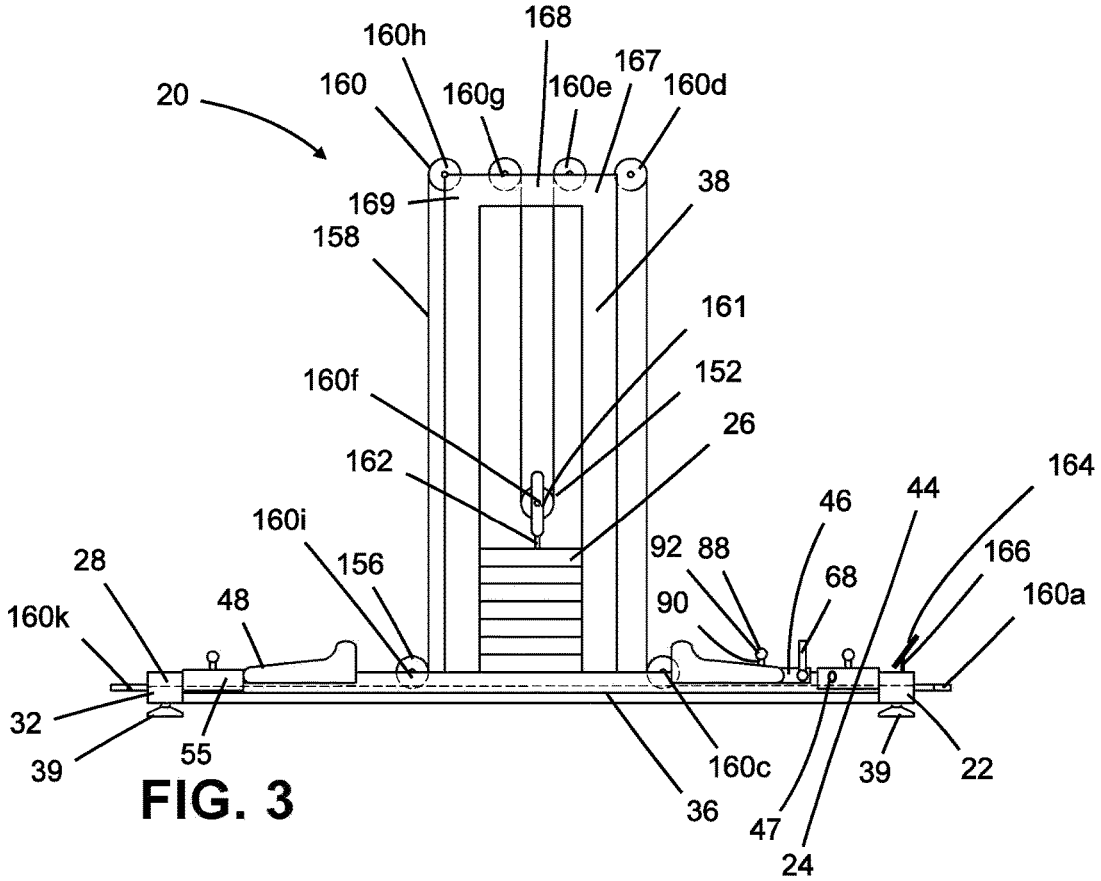
FIG. 3 is a front elevation view of the exercise device of FIG. 1.

Referring to FIGS. 1-3, an exercise system 20 configured to permit a user to move between an extended position to a crunch position while providing variable resistance is shown. The exercise system 20 includes a frame 22, at least one carriage 24 slidingly engaged with the frame 22, and a resistance assembly 26 configured to apply a predetermined level of resistive force to the at least one carriage 24.

As shown in FIGS. 1-3, in one example, the frame 22 includes a U-shaped base 28 having a first side member 30, a second side member 32, and a backend member 34 extending between ends of the first and second side members 30, 32. The frame 22 includes a guide rail 36 and a vertical support member 38 extending vertically upward from the backend member 34 of the base 28. The vertical support member 38 is configured to support the resistance assembly 26, which is described in greater detail below. The guide rail 36 includes a first end 40 attached to the first side member 30 and a second end 42 attached to the second side member 32. As best shown in FIG. 3, the frame 22 can include a plurality of feet 39 configured to engage the ground surface. The plurality of feet 39 can be adjusted to compensate for uneven ground surfaces.

The at least one carriage 24 is configured to be slidingly engaged with the guide rail 36 to translate in a reciprocating motion in a forward direction and a rearward direction with respect to the first end 40 and second end 42 of the guide rail 36. In one example, the least one carriage 24 can be slidingly attached to the guide rail 36 via a trolley system 50 (FIG. 1). As shown in FIG. 1, the trolley system 50 can include a pair of linear tracks 52 extending along each side of the guide rail 36 between the first end 40 and the second end 42. Each linear track 52 is configured to receive wheels or rollers 54 rotatably attached to each side of the at least one carriage 24 thereby permitting the at least one carriage 24 to translate in a reciprocating motion in the forward direction (e.g., towards the first end 40 of the guide rail 36) and rearward direction (e.g., towards the second end 42 of the guide rail 36), as shown by arrow A. It should be appreciated that a skilled artisan may employ other suitable guides or track systems known in the art to slidingly attach the at least one carriage 24 to the guide rail 36, as desired. Non-limiting examples can include linear guide rails, double axis linear guide rails, tube tracks with rollers, U-shaped groove tracks, V-grooved guides with rollers, linear bearing track, or any other guide known in the art.

With reference to FIG. 1, the exercise system 20 can include at least one lock mechanism 88 configured to selectively secure the at least one carriage 24 to the guide rail 36. In one example, the lock mechanism 88 can include a post 90, a pin 91 disposed in the post 90, and a knob 92 attached to the pin 91. The guide rail 36 defines lock holes 94 configured to receive the pin 91. In operation, the user pulls the pin 91 up out of the lock hole 94 via the knob 92, slides the carriage 24 to align the pin 91 with the lock hole 94 corresponding to the desired location, and releases the knob 92 causing the pin 91 to pass into the lock hole 94 thereby locking the carriage 24 in place.

As shown in FIGS. 1-3, in one example, the at least one carriage 24 includes a carriage 44, an upper extremity or upper body carriage 46, and a lower extremity or lower body carriage 48. In the example shown in FIGS. 1-3, the upper body carriage 46 is disposed between the carriage 44 and the lower body carriage 48. The upper body carriage 46 includes a top side 56, a right side 58, and a left side 60. The upper body carriage 46 includes an upper body support 62 having a lower right extremity support 64 attached to and extending from the right side 58 and a lower left extremity support 66 attached to and extending from the left side 60. The lower right and left extremity supports 64, 66 are configured to receive the lower right arm and the lower left arm, respectively, of the user.

With reference to FIG. 1, each one of the lower right extremity support 64 and the lower left extremity support 66 can include a groove 82 to provide increased support and comfort of the user's arms. The upper body support 62 can include a padded material for increased comfort while the user is using the exercise system 20. The padded material can include the groove 82. The padded material can be made of a nonporous material that is easy to clean to inhibit the upper body support 62 from being saturated by perspiration.

In one example, each one of the lower right extremity support 64 and the lower left extremity support 66 can include a backing 84 configured to engage an elbow of the user. More specifically, the lower right and left extremity supports 64, 66 are configured to receive the forearm of the user's respective arm such that the elbow is in contact with the backing 84. The lower right extremity support 64 and the backing 84 can be one component or can be separate components. Likewise, the lower left extremity support 66 and the backing 84 can be one component or can be separate components. The backing 84 can be configured to provide additional support when the user is exerting force against the resistance force applied to the upper body carriage 46 via the resistance assembly while the user is moving between the extended position (FIG. 4) and the crunch position (FIG. 5), which is described in greater detail below. In another example, each one of the lower right extremity support 64 and the lower left extremity support 66 can include a downward sloping elbow support to provide additional support when the user is exerting force against the resistance force applied to the upper body carriage 46.

Figure 16:
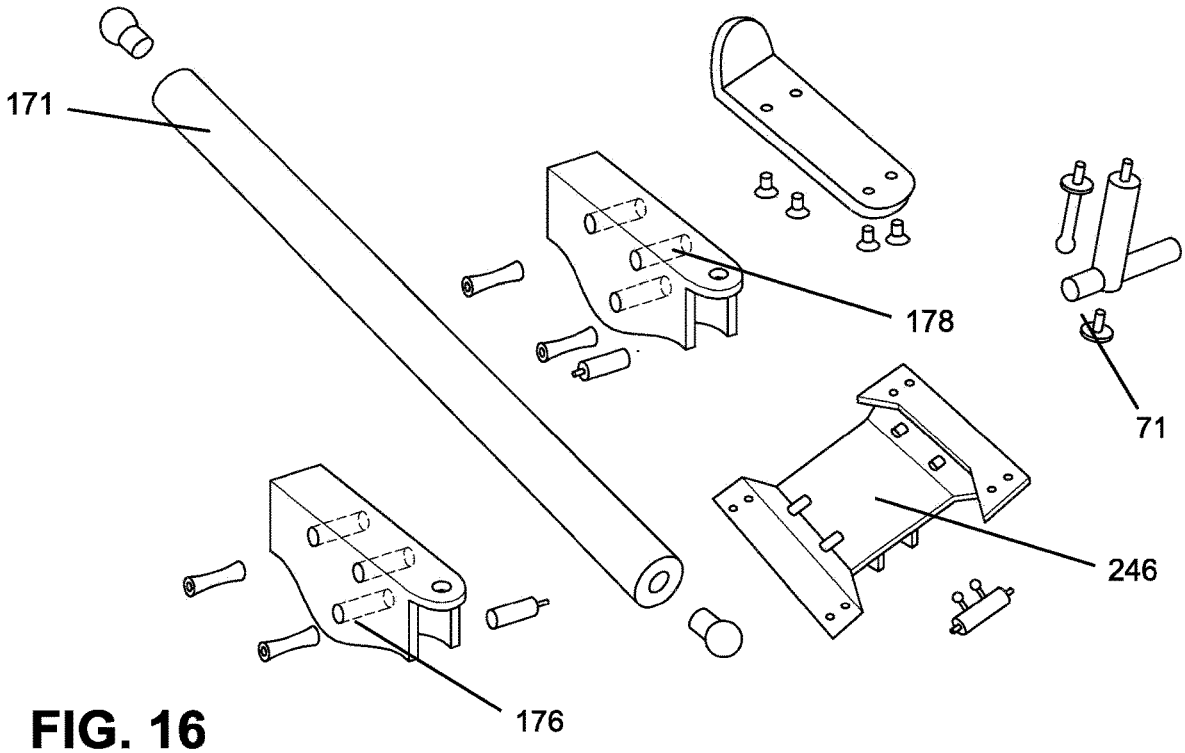
FIG. 16 is an exploded view of a right guide rail including a linear shaft and corresponding upper body carriage according to the present disclosure.

With continued reference to FIG. 1, the upper body carriage 46 can include a pair of ergonomic vertical handles 68 for the user to grip while using the exercise system 20. The vertical handles 68 are adapted to pivot about a horizontal pivot axis X for angular orientation adjustment for the user's comfort, stability, and controllability while using the exercise system 20. The vertical handles 68 are attached to the right side and left sides 58, 60 of the upper body carriage 46 via a post and bracket 71 (FIG. 16). More specifically, the vertical handles 68 include a right hand handle 70 and a left hand handle 72. The right hand handle 70 includes a horizontal post 74 pivotably secured to and extending from the right side 58 and a vertical post 76 extending from the horizontal post 74. The left hand handle 72 includes a horizontal post 78 pivotably secured to and extending from the left side 60 and a vertical post 80 extending from the horizontal post 78. In one example, the vertical handles 68 can include grips surrounding the vertical handles 68 for increased grip control. The grips can be, for example, a soft, pliable, deformable, and/or textured material to provide increased grip friction, cushioning and shock absorption.

In one example, the upper body carriage 46 can include a push button lock pin assembly 41 to lock the upper body carriage 46 to the carriage 44 such that the upper body carriage 46 and carriage 44 move simultaneously with one another, which is described in greater detail below. The push button lock pin assembly 41 includes a push button 43 disposed at the top of each vertical handle 68 and a locking pin 45 (FIG. 2) configured to protrude from a bottom portion of the vertical handle 68 and pass into the upper body carriage 46. The locking pin 45 is received by a pin hole 47 (FIG. 3) disposed on each side of the carriage 44. When the upper body carriage 46 and carriage 44 are locked together, a front portion 51 of the upper body carriage 46 surrounds a rear portion 53 of the carriage 44.

In one example, the upper body carriage 46 can further include a pair of horizontal handles 86 extending from the right side and left sides 58, 60 such that the horizontal handles 86 are substantially parallel to the floor. Providing a pair of vertical handles 68 and a pair of horizontal handles 86 permits the user a wider range of hand positions and thus exercises, which is described in greater detail below.

Figure 6:
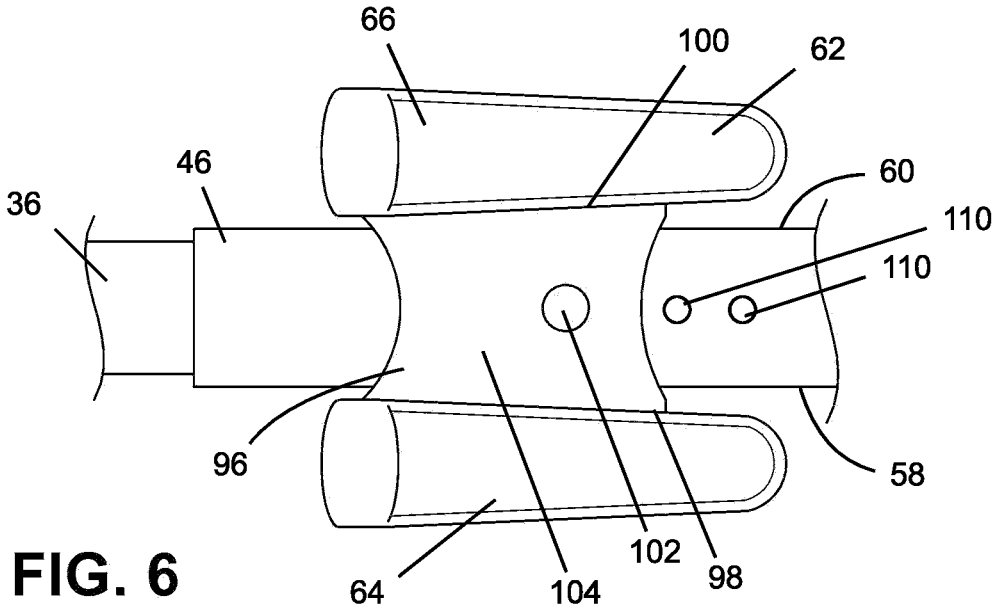
FIG. 6 is a top plan view of an upper body carriage according to one embodiment the present disclosure.
Figure 7:
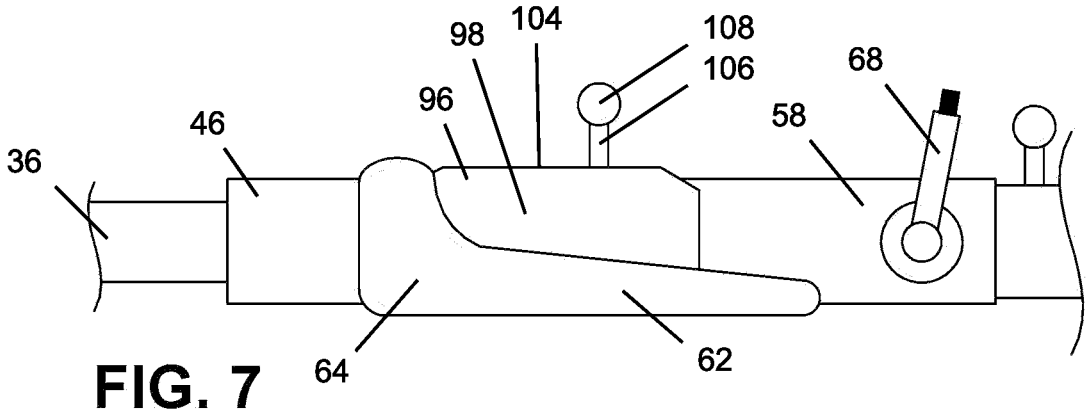
FIG. 7 is a side elevation view of the upper body carriage of FIG. 6.
Figure 9:
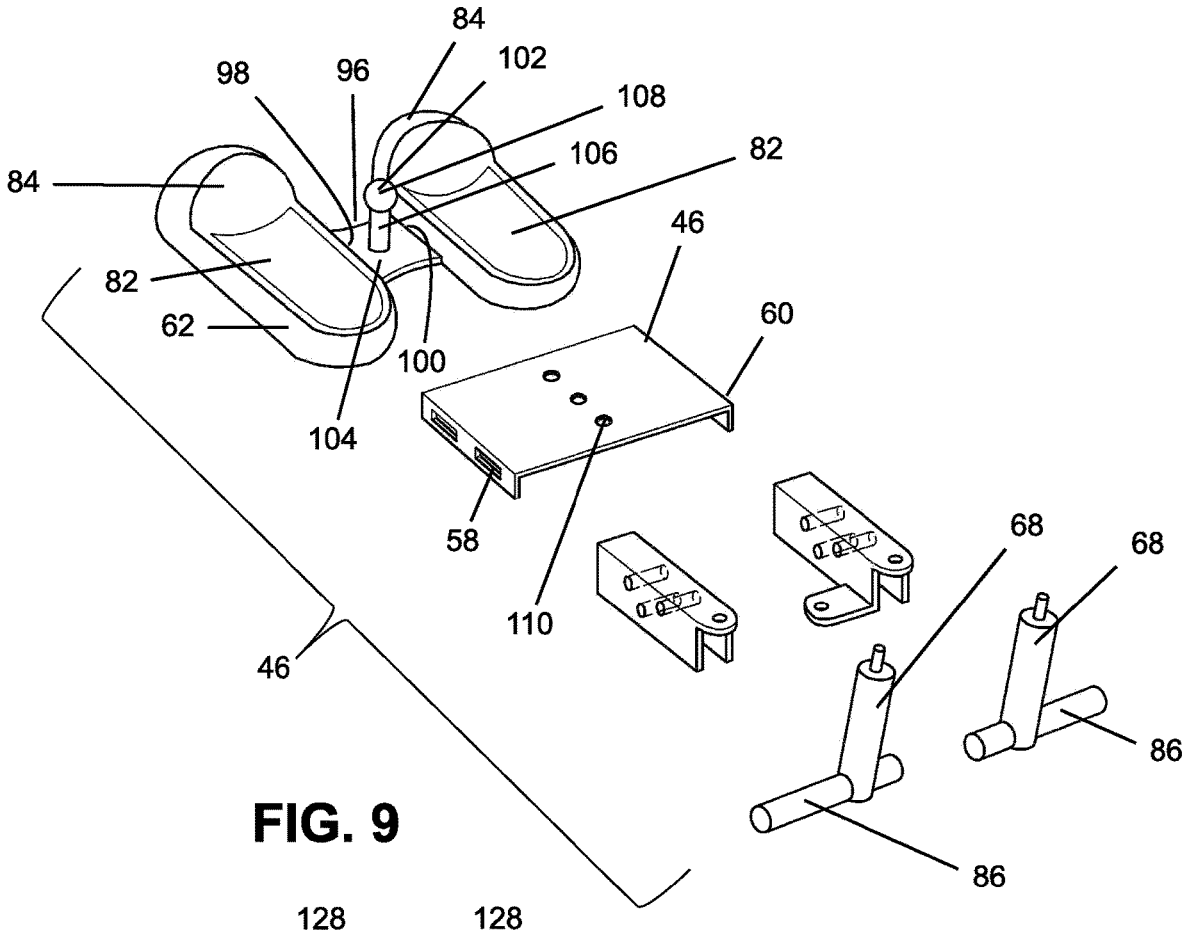
FIG. 9 is an exploded view of an upper body carriage and corresponding upper body support according to the present disclosure.

Referring to FIGS. 6-7 and 9, in another embodiment, the upper body carriage 46 includes a top support 96 slidingly coupled to the upper body carriage 46 such that the top support 96 surrounds a portion of the upper body carriage 46. As described above, the pair of vertical handles 68 are attached to the right side 58 and left side 60 of the upper body carriage 46. However, instead of the upper body support 62 being attached to the upper body carriage 46, the upper body support 62 is attached to the top support 96 for adjusting a distance between the pair of vertical handles 68 and the upper body support 62 to accommodate varying arm lengths. More specifically, the lower right extremity support 64 can be attached to and extend from a right side 98 of the top support 96 and the lower left extremity support 66 can be attached to and extend from a left side 100 of the top support 96. The top support 96 can include a lock device 102 configured to secure the top support 96 to the upper body carriage 46. In one example, the lock device 102 is disposed on a top side 104 of the top support 96 and includes a post 106 and a knob 108. The upper body carriage 46 defines holes 110 configured to receive the post 106. In operation, the user pulls the post 106 up out of the hole 110 via the knob 108, slides the top support 96 to align the post 106 with the hole 110 corresponding to the predetermined location based on the length of the user's arms, and releases the knob 108 causing the post 106 to pass into the hole 110 thereby locking the top support 96 into the predetermined location or the user's desired position. Advantageously, the upper body support 62 can be adjusted to accommodate varying arm lengths of different users such that the arm of the user can comfortably rest on the upper body support 62 while gripping the vertical handles 68 or horizontal handles 86.

Figure 8:
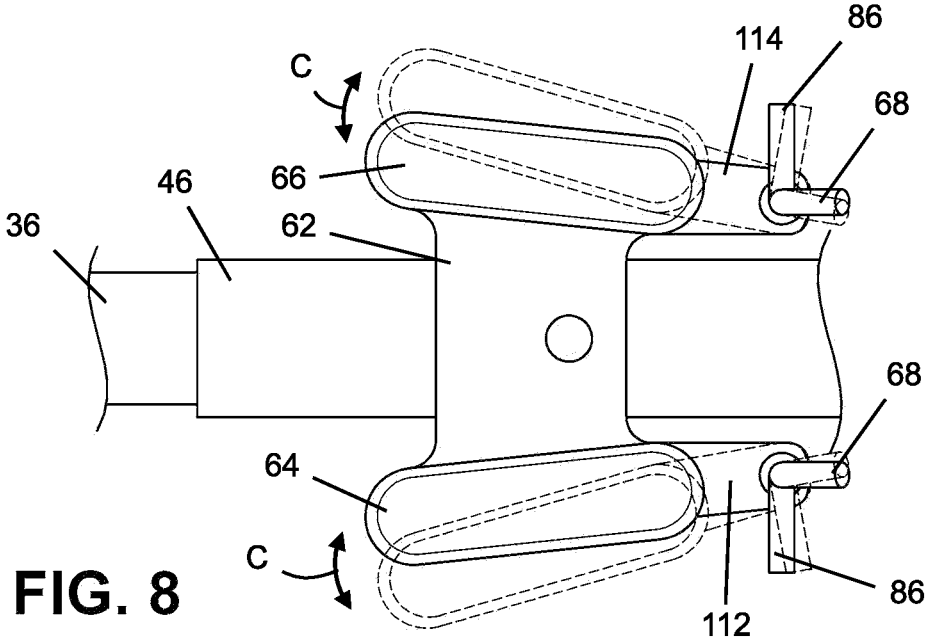
FIG. 8 is a top plan view of an upper body carriage according to another embodiment of the present disclosure.

Referring to FIG. 8, in another embodiment, the lower right extremity support 64 can be secured to a right support plate 112 and the lower left extremity support 66 can be secured to a left support plate 114. The lower right extremity support 64 and the lower left extremity support 66 can be secured to the right support plate 112 and the left support plate 114 by any joining method known in the art such as for example, a screw connection. In one example, the right and left support plates 112, 114 can be configured to pivot (as shown by arrow C) such that a distance between the lower right and left extremity supports 64, 66 varies. For example, the lower right and left arm supports 64, 66 can move from a first position (shown in solid lines) to a second position (shown in dashed lines) to increase the distance between ends of the lower right and left extremity supports 64, 66 such that the distance between the users right and left elbows increase. In one example, the vertical handles 68 and the horizontal handles 86 can be secured on top of the right and left support plates 112, 114 thereby causing the orientation of the vertical handles 68 and horizontal handles 86 to pivot with the right and left support plates 112, 114 for increased user comfort, stability, and controllability while using the exercise system 20.

Referring back to FIGS. 1-3, the lower body carriage 48 is disposed between the upper body carriage 46 and the second side member 32 of the frame 22. The lower body carriage 48 defines a top side 116, a right side 118, and a left side 120. The lower body carriage 48 includes a lower body support 122 having a right extremity support 124 attached to and extending from the right side 118 and a left extremity support 126 attached to and extending from the left side 120. The right and left extremity supports 124, 126 are configured to receive the lower right extremity and the lower left extremity (e.g., a leg or a foot), respectively, of the user.

Figure 10:
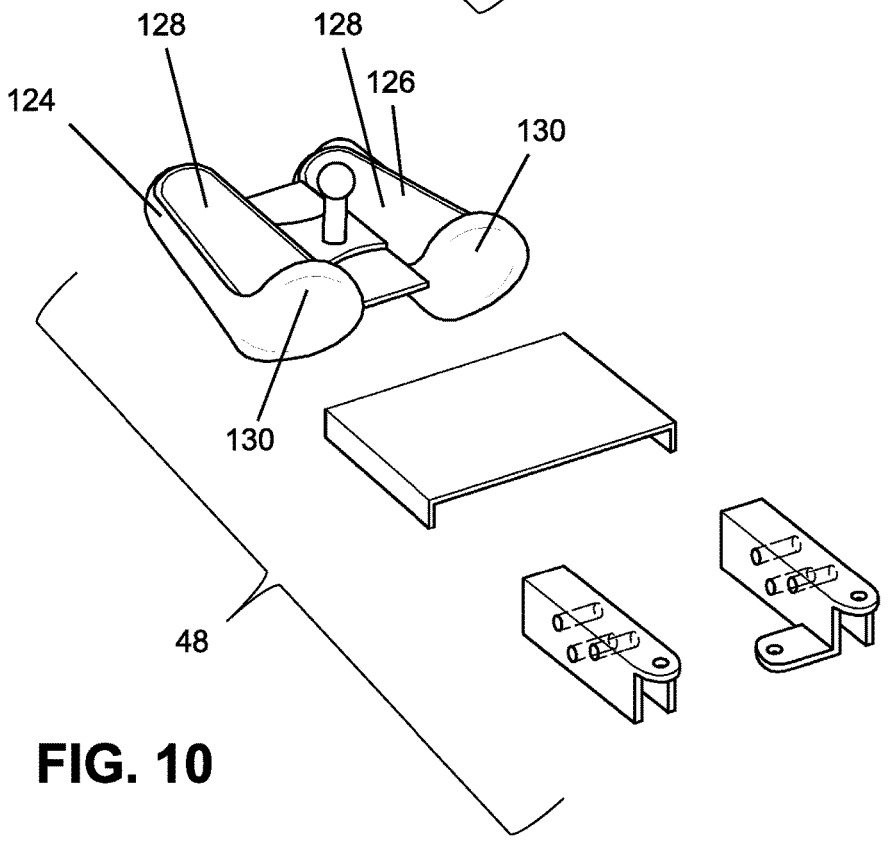
FIG. 10 is an exploded view of a lower body carriage and corresponding lower body support according to the present disclosure.

With reference to FIGS. 1 and 10, each one of the right extremity support 124 and the left extremity support 126 of the lower body carriage 48 can include a groove 128 to provide increased support and comfort of the user's lower extremities. The lower body support 122 can include a padded material for increased comfort while the user is using the exercise system 20. The padded material can include the groove 128. The padded material can be made of a nonporous material that is easy to clean to inhibit the lower body support 122 from being saturated by perspiration.

In one example, each one of the right extremity support 124 and the left extremity support 126 of the lower body carriage 48 can include a vertical support 130 configured to engage a knee or foot of the user. More specifically, in one example, the right and left extremity supports 124, 126 are configured to receive the shin or toes of the user's respective leg such that the knee is in contact with the vertical support 130. The right extremity support 124 and the vertical support 130 can be one component or can be separate components. Likewise, the left extremity support 126 and the vertical support 130 can be one component or can be separate components. The vertical support 130 can be configured to provide additional support when the user is exerting force against the resistance force applied to the upper body carriage 46 via the resistance assembly while the user is moving between the extended position (FIG. 4) and the crunch position (FIG. 5), which is described in greater detail below. In another example, each one of the right extremity support 124 and the left extremity support 126 of the lower body carriage 48 can include a downward sloping elbow support to provide additional support when the user is exerting force against the resistance force applied to the lower body carriage 48.

Referring back to FIGS. 1-2, the carriage 44 can be disposed between the upper body carriage 46 and the first side member 30 of the frame 22. The carriage 44 can be configured to translate in a reciprocating motion in the forward and rearward direction. The carriage 44 can act as a positioning carriage (e.g., shown in positioning mode in FIG. 1) or a tensioning carriage (e.g., shown in tensioning mode in FIG. 11). The carriage 44 defines a top side 132, right side 134, a left side 136, a rear side 138 and a front side 140.

In one example, the carriage 44 can act as a tensioning carriage configured to engage with the upper body carriage 46 such that the carriage 44 and upper body carriage 46 simultaneously translate between the forward direction and rearward direction. The upper body carriage 46 is configured to be detachably secured to the carriage 44 via the push button lock pin assembly 41. The right side 134 and the left side 136 of the carriage 44 each defines a pin hole 47 (FIG. 3) configured to receive the locking pin 45 (FIG. 2) of the push button lock pin assembly 41. In operation, the user simultaneously holds the push button 43 down on each of the vertical handles 68 thereby releasing the spring pressure that holds the locking pin 45 in a locked position and slides the upper body carriage 46 in the forward direction towards the carriage 44. The front portion 51 of the upper body carriage 46 receives and overlaps the rear portion 53 of the carriage 44 until the lock pin 45 is aligned with and received by the corresponding pin hole 47.

In another example, carriage 44 is configured to act as a positioning carriage adapted for locking engagement with the guide rail 36 such that the upper body carriage 46 moves without the carriage 44. In this example, the carriage 44 is configured to act as an anchor point and/or a stopper. The lock mechanism 88 is disposed on the top side 132 of the carriage 44 and configured to secure the carriage 44 to the guide rail 36. In operation, when the user is positioned on the exercise system 20 and moving from the crunch position (FIG. 5) to the extended position (FIG. 4), the upper body carriage 46 translates in the forward direction toward the carriage 44 until a front side 142 of the upper body carriage 46 makes contact with the rear side 138 of the carriage 44 thereby inhibiting the upper body carriage 46 from moving further.

With reference to FIG. 1, the resistance assembly 26 is configured to control the amount of resistance encountered by the user with respect to the upper body carriage 46, the lower body carriage 48, and/or the carriage 44. In one example, the resistance assembly 26 includes a weight stack 144 disposed at the vertical member 38 of the frame 22. The weight stack 144 includes a plurality of weight plates 146 stacked vertically on top of one another. Each weight plate 146 includes a guide hole 148 configured to receive a guide rod 150, wherein the weight plates 146 can slide up and down the guide rod 150 when lifted and lowered via a connecting mechanism 152. Each weight plate 146 defines a pin hole 154 configured to receive a connecting pin for allowing the user to select the number of weight plates 146 corresponding to the desired exercise weight. Once the connecting pin is inserted into the pin hole 154 of a selected weight plate 146, the selected weight plate 146 and weight plates 146 above the selected weight plate 146 are mechanically connected to the upper body carriage 46 and/or the lower body carriage 48 via the connecting mechanism 152, which is described in greater detail below.

It should be appreciated that a skilled artisan may employ other suitable resistance assemblies, as desired. Non-limiting examples of resistance assemblies can include free weights, free weight plates, hydraulic resistance assemblies, a flywheel, a resistance band, or any other resistance assemblies known in the art.

With reference to FIGS. 2-3, the connecting mechanism 152 is configured to mechanically couple the at least one carriage 24 to the resistance assembly 26. In one example, the connecting mechanism 152 can include a cable and pulley system 156. The cable and pulley system 156 can include a cable 158 and a plurality of pulleys 160.

In a non-limiting example, the cable 158 includes a first end 159 affixed to the carriage 44 and a second end 161 affixed to a lift member 162, which in turn, is connected to the upper most weight plate 146. The cable 158 extends from the carriage 44 towards the first side member 30 of the frame 22, around a 1st pulley 160*a* located at the first side member 30 of the frame 22 proximate the first end 40 of the guide rail 36, and around a 2nd pulley 160*b* located at a back end first side member 30. The cable 158 extends from the 2nd pulley 160*b* and runs over a 3rd pulley 160*c* located on the backend member 34 of the frame 22 proximate the vertical member 38, extends upward along the vertical member 38 towards the top 168, runs over a 4th pulley 160*d* located proximate a top right corner 167 of the vertical member 38, and runs over a 5th pulley 160*e*. The cable 158 extends from the 5th pulley 160*e* downward towards the weight stack 144 where the cable 158 is secured to a lift member 162, which in turn, is connected to the upper most weight plate 146.

The cable 158 extends from the carriage 44 towards the first side member 30 and through the frame 22, around a 1st pulley 160*a* located at the first side member 30 of the frame 22 proximate the first end 40 of the guide rail 36, and around a 2nd pulley 160*b* located at a back end first side member 30. The cable 158 extends from the 2nd pulley 160*b* and runs over a 3rd pulley 160*c* located on the backend member 34 of the frame 22 proximate the vertical member 38, extends upward along the vertical member 38 towards the top 168, runs over a 4th pulley 160*d* located proximate a top right corner 167 of the vertical member 38, and runs over a 5th pulley 160*e*. The cable 158 extends from the 5th pulley 160*e* downward towards the weight stack 144 and around a 6th pulley 160*f* connected to a lift member 162, which in turn, is connected to the upper most weight plate 146. In one example, in operation, where the upper body carriage 46 is secured to the carriage 44, the user exerts force on the upper body carriage 46, which is translated through the cable 158 and to the weight stack 144, which is described in greater detail below.

In another example, as shown in FIG. 2, where the upper body carriage 46 is not secured to the carriage 44 the cable 158 continues to extend from the 6th pulley 160*e* back up towards the top 168 of the vertical member 38, runs over a 7th pulley 160*g* located at the top 168, runs over an 8th pulley 160*h* located at a top left corner 169 of the vertical member 38, extends downward toward the backend member 34 of the frame 22, and runs over a 9th pulley 160*i* located on the backend member 34. The cable 158 extends towards the second side member 32 of the frame 22, runs over a 10th pulley 160*j*, extends from the 10th pulley, and runs over an 11th pulley 160*k* located at the second side member 32 proximate the second end 42 of the guide rail 36. The cable 158 enters the second end 42 of the guide rail 36, extends towards the carriage 44, runs around a $12^{th}$ pulley 1601 located inside the carriage 44, extends toward the upper body carriage 46, and finally ending and anchored at the upper body carriage 46. An end 163 of the cable 158 is configured to be affixed to the upper body carriage 46. When the user exerts force on the upper body carriage 46, the force exerted is translated through the cable 158 and to the weight stack while the first end 159 of the cable 158 is affixed to the stationary carriage 44., which is described in greater detail below.

It should be appreciated that a skilled artisan may scale the number and location of the cable and pulley system 156 and/or the resistance assembly 26, as desired.

With reference to FIG. 3, the exercise system 20 can include a display 164 configured to present training videos, exercise program classes, entertainment, images, statuses such as distance or resistance level, physiological conditions of the user, a timer, user progress, and monitoring data, among other information. In one example, the exercise system 20 can include physiological sensors configured to collect and track physiological information such as heart rate, respiration, muscle conditions, blood pressure, oxygen level, pulse, among other physiological conditions. The exercise system 20 can include additional tracking sensors to collect and track other information such as performance information including distance. The physiological information from the physiological sensors and other performance information from the tracking sensors can be presented to the user on the display 164.

In another example, the exercise system 20 can include a display support 166 for securing a display, such as a smartphone or tablet, to the exercise system 20.

Figure 4:
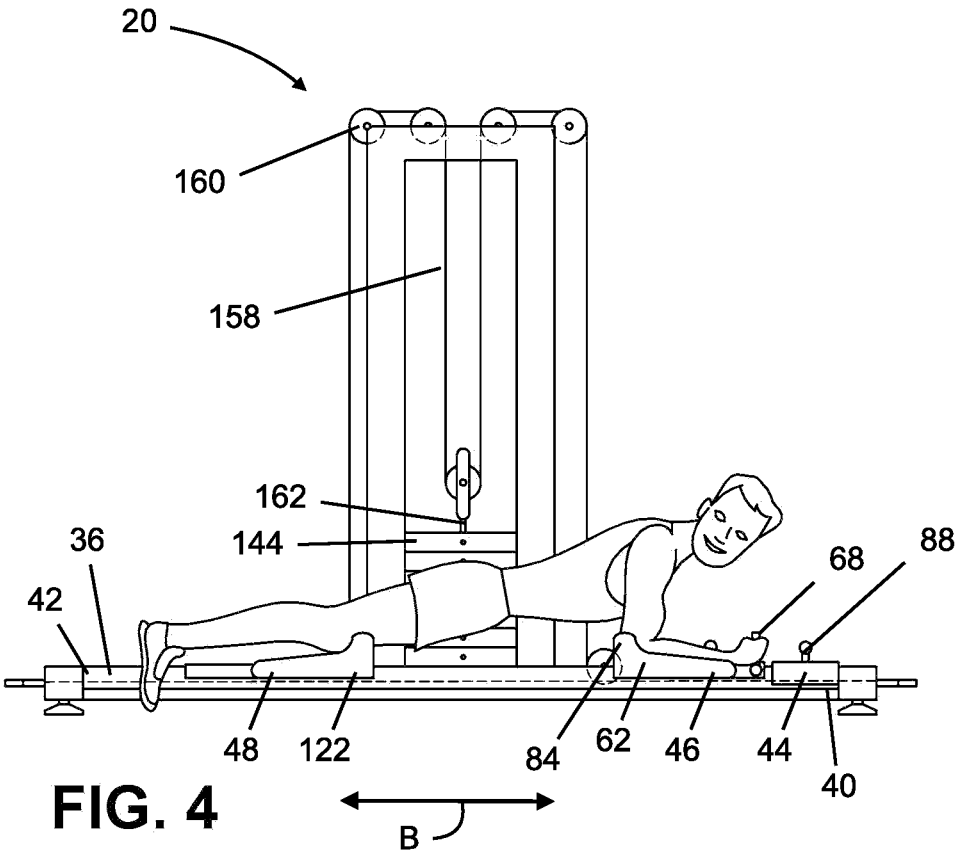
FIG. 4 is a front elevation view of an exercise device according to the present disclosure, depicting a user in an extended position.
Figure 5:
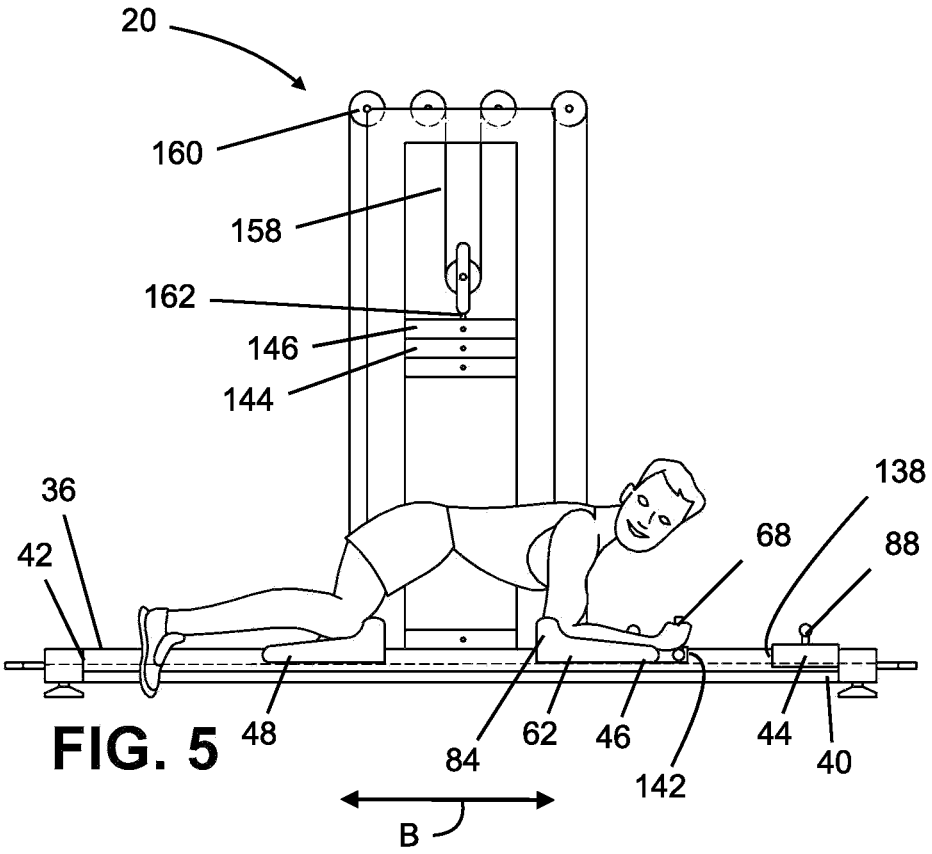
FIG. 5 is a front elevation view of an exercise device according to the present disclosure, depicting a user in a crunch position.

Referring to FIGS. 4-5, the exercise system 20 is configured to allow the user to move between an extended position (FIG. 4) and a crunch position (FIG. 5) via translating back and forth about the guide rail 36, as shown by arrow B. In the example shown in FIGS. 4-5, the user is face down and performing a plank to abdominal crunch exercise that primarily targets the core abdominal muscle group, upper body extremity muscle groups, chest, biceps, triceps, shoulders, lower arm, and forearm, and secondarily targets the lower extremities, hips, glutes, quadriceps, and hamstring muscles.

In FIG. 4, to begin, the lower body carriage 48 is secured in place to the guide rail 36. In one example, the lower body carriage 48 can be locked to the guide rail 36 via the lock mechanism 88. The upper body carriage 46 and the carriage 44 are locked together via the push button lock pin assembly 41 such that the upper body carriage 46 and the carriage 44 can simultaneously translate back and forth about the guide rail 36 (e.g., carriage 44 acting as a tension carriage). The user can begin in a start position in which the user places knee on lower body support 122 and forearms in the upper body support 62 such that the elbows are in contact with the backing 84 and the hands are gripping the vertical handles 68. The user is positioned on the lower body support 122 and upper body support 62 such that the user is face down in a traditional low plank position.

Alternatively, as shown in FIG. 4, instead of the carriage 44 being locked to and simultaneously translating with the upper body carriage 46, the carriage 44 is secured to the guide rail 36 via the lock mechanism 88 to a desired position depending on the user's height. As such, the lower body carriage 48 and the carriage 44 are secured to the guide rail 36 while the upper body carriage 46 freely translates back and forth about the guide rail 36 under tension while connected to the resistance assembly (e.g., cable and pulley system). The user can begin in a start position (e.g., plank position) in which the user places knee on lower body support 122 and forearms in the upper body support 62 such that the elbows are in contact with the backing 84 and the hands are gripping the vertical handles 68 or horizonal handles 86. The user is positioned on the lower body support 122 and upper body support 62 such that the user is face down in a traditional low plank position.

In FIG. 5, the user is in contact with the upper body carriage 46 and exerts force on the upper body carriage 46 to slide the upper body carriage 46 in the rearward direction (e.g., towards the second end 42 of the guide rail 36) and into the crunch position such that the force exerted on the upper body carriage 46 is translated through the cable 158 and to the weight stack 144. In other words, as the user slides the upper body carriage 46 in the rearward direction, the force applied to the upper body carriage 46 is transmitted through the cable 158, rotating the plurality of pulleys 160 such that the force transmitted to the cable 158 acts on the lift member 162 attached to the weight stack 144 thereby lifting the selected number of weight plates 146. The user can hold the crunch position for a preselected amount of time or until the user experiences muscle fatigue causing the user to move to the extended position thereby retracting muscles back into the start position. The backing 84 of the upper body support 62 can act as stopper and provide increased support against the resistance force applied to the upper body carriage via the resistance assembly 26 thereby inhibiting the user's arms from sliding or hanging off the upper body carriage 46 while the user is moving between the rearward and forward directions, as shown by arrow B in FIGS. 4-5.

Next, the user slides the upper body carriage 46 in the forward direction (e.g., towards the first end 40 of the guide rail 36) returning to the plank position until the front side 142 of the upper body carriage 46 makes contact with the rear side 138 of the carriage 44 thereby inhibiting the upper body carriage 46 from moving further forward. As discussed above, the location of the carriage 44 can be adjusted to accommodate the height of the user. For example, a user that is taller can position the carriage 44 closer to the first end 40 of the guide rail 36 to increase the distance between the lower body carriage 48 and upper body carriage 46 to correspond to the height of the user thereby allowing the user to fully extend into the plank position. A user that is shorter can position the carriage 44 further away from the first end 40 to decrease the distance between the lower body carriage 48 and upper body carriage 46 to correspond to the height of the user thereby inhibiting the upper body carriage 46 and thus the arms of the user from sliding too far forward, which in turn, decreases the chance of injury.

In another non-limiting example, the user can perform a plank to pike exercise that primarily targets the core abdominal muscle group, including both the upper abdomen and lower abdomen, and glutes, and secondarily targets shoulders, glutes, and lower back. To begin, the upper body carriage 46 and the carriage 44 are locked to the guide rail 36 via the lock mechanism 88. The lower body carriage 48 can freely translate back and forth about the guide rail 36 while the end 163 of the cable 158 is secured to the lower body carriage 48. As best shown in FIG. 3, the exercise system 20 can include a second carriage 55 disposed between the lower body carriage 48 and the second side member 32 of the base 28. In one example, the second carriage 55 is configured for locking engagement with the lower body carriage 48 such that the second carriage 55 and the lower body carriage 48 simultaneously translate in a reciprocating motion in the forward and rearward direction.

In the start position, the user can be in a high plank position in which the user places toes on lower body support 122 and hands gripping the horizontal handles 86. When performing the plank to pike exercise, the user does not place the forearms in the upper body support 62. Once the toes are resting on the upper body carriage 46 and hands gripping the horizontal handles 86, the user raises hips and draws legs towards the hands thereby sliding the lower body carriage 48 via the feet towards the upper body carriage 46 until the body of the user is in an inverted V position. The user can hold this position for a predetermined amount of time or until the user experiences muscle fatigue causing the user to return to the start position. The user returns to the start position by sliding the lower body carriage 48 in the rearward direction and repeats as desired.

In another non-limiting example, the user can perform a knee tuck exercise that primarily targets the core abdominal muscle group and glutes, and secondarily targets the shoulders and chest. To begin, the upper body carriage 46 and the carriage 44 are locked to the guide rail 36 via the lock mechanism 88. The lower body carriage 48 can freely translate back and forth about the guide rail 36. In one example, the lower body carriage 48 and the second carriage 55 can be locked together such that the lower body carriage 48 and second carriage 55 simultaneously translate in a reciprocating motion in the forward and rearward direction.

In the start position, the user can be in a high plank position in which the user places lower extremities, such as the user's toes, on lower body support 122 and hands gripping the horizontal handles 86. When performing the knee tuck exercise, the user does not place the forearms in the upper body support 62. Once in the start position, with a contracted core and flat back, the user bends knees and slides the lower body carriage 48 via the toes towards the upper body carriage 46 such that the knees slide toward the chest. The user can hold this position for a predetermined amount of time or until the user experiences muscle fatigue causing the user to return to the start position. The user returns to the start position by sliding the lower body carriage 48 in the rearward direction and repeats as desired.

Referring to FIGS. 11-14, in another embodiment, an exercise system 200 can include two or more guide rails to provide increased user stability and control while performing various exercises on the exercise system 200. The exercise system 200 includes a frame 222, a right guide rail 170, a left guide rail 172, and a central guide rail 174 disposed between the right guide rail 170 and the left guide rail 172. Each one of the right, left, and central guide rails 170, 172, 174 extend between a first side member 230 and a second side member 232 of the frame 222. The exercise system 200 further includes a carriage 244, an upper body carriage 246, a lower body carriage 248, and a resistance assembly 226 (FIG. 11) configured to apply a predetermined level of resistive force to at least one of the carriage 244, an upper body carriage 246, and a lower body carriage 248.

Figure 11:
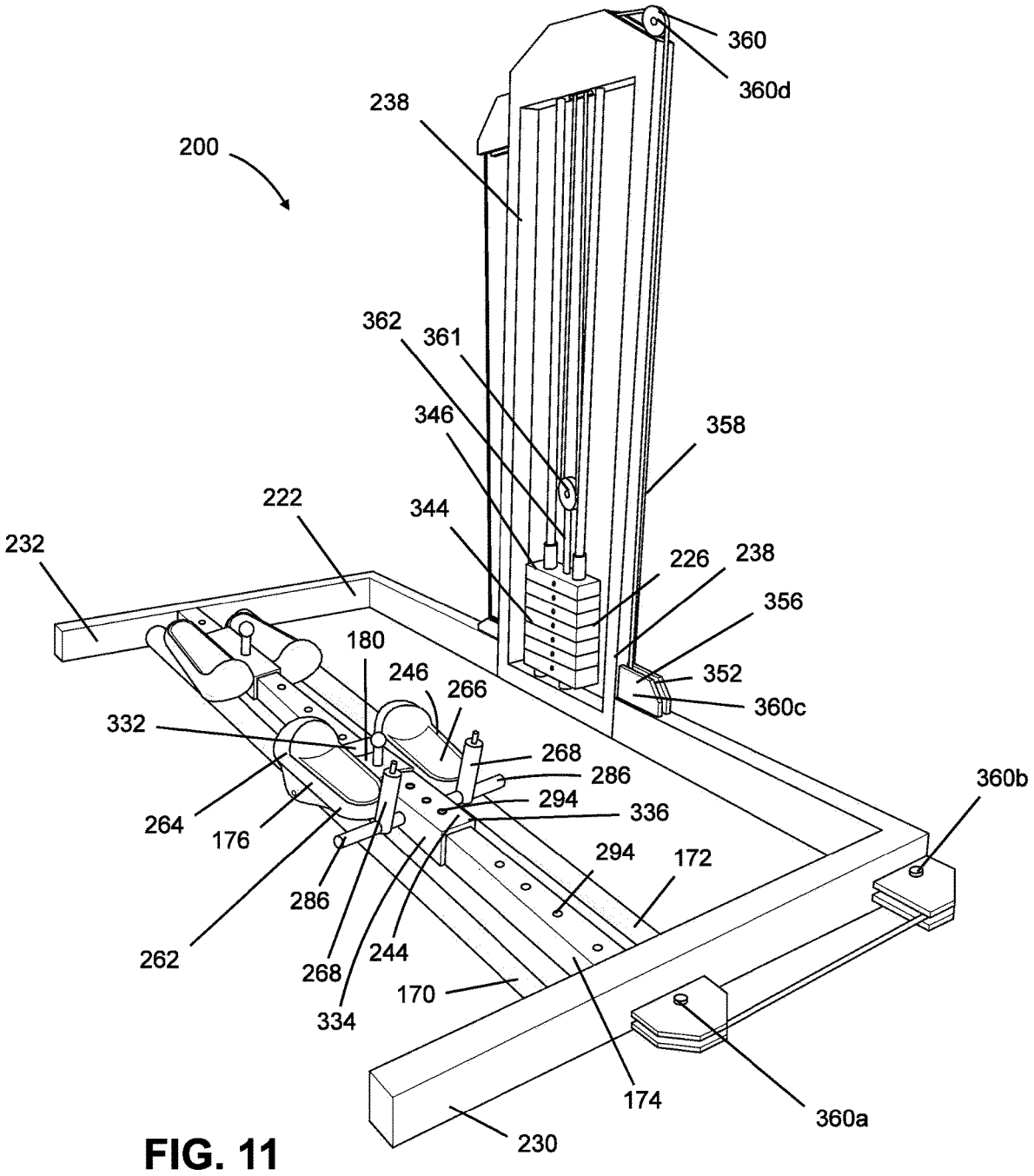
FIG. 11 is a perspective view of an exercise device according to another embodiment of the present disclosure.
Figure 14:
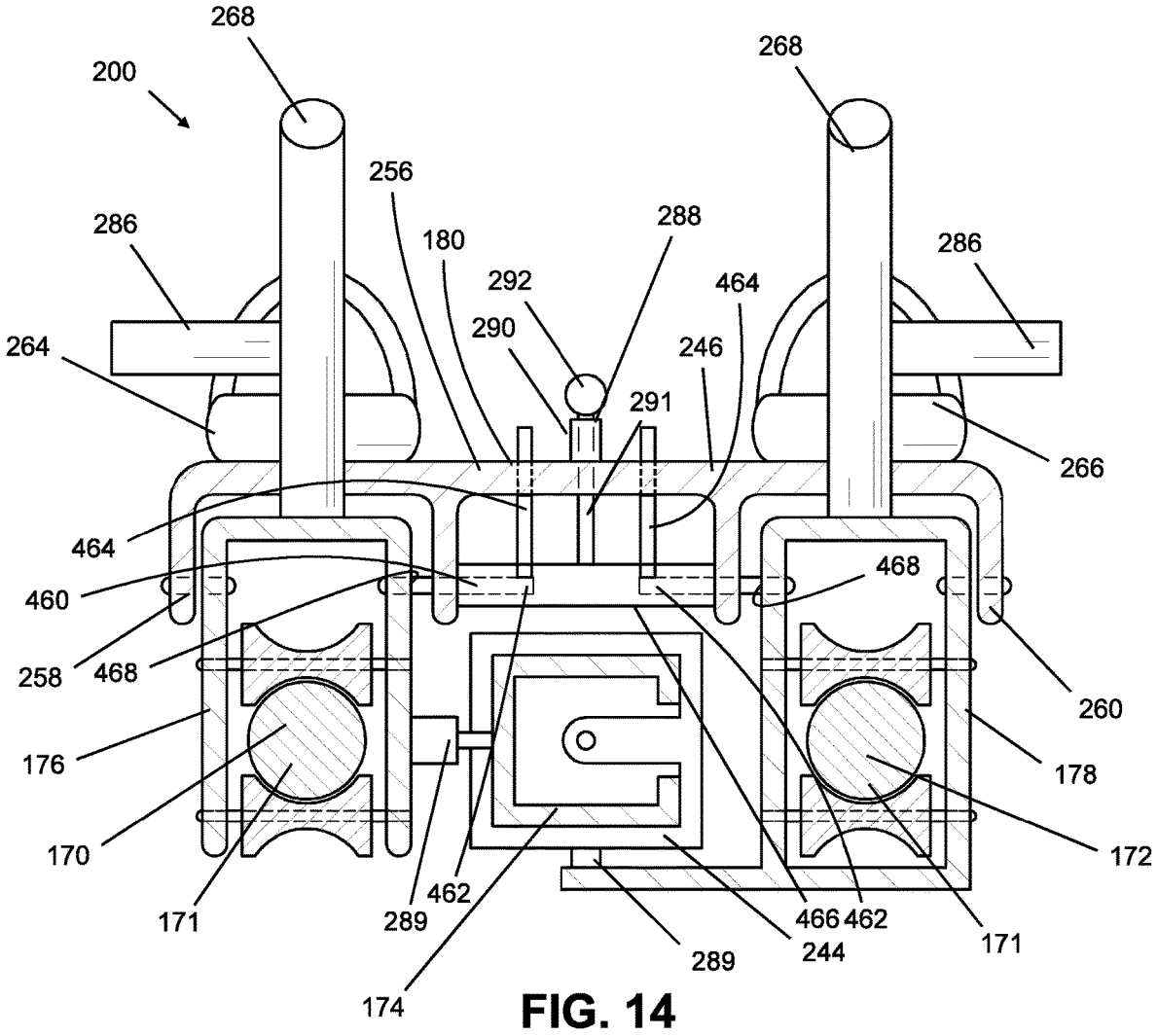
FIG. 14 is a front cross-sectional view of an upper body carriage and carriage slidingly attached to a track assembly according to the present disclosure.

With reference to FIG. 14, the exercise system 200 can include a lock mechanism 288 configured to secure the carriage 244, the upper body carriage 246, and/or lower body carriage 248 to the central guide rail 174, the right guide rail 170 and/or the left guide rail 172. In one example, the lock mechanism 288 can include a post 290, a pin 291 disposed in the post 290, and a knob 292 attached to the pin 291. The lock mechanism 288 can be disposed on the carriage 244, the upper body carriage 246, and/or lower body carriage 248. As shown in FIG. 11, the central guide rail 174, the right guide rail 170 and/or the left guide rail 172 can define lock holes 294 configured to receive the pin 291 thereby locking the carriage 244, the upper body carriage 246, and/or lower body carriage 248 to the central guide rail 174, the right guide rail 170 and/or the left guide rail 172. It should be appreciated that a skilled artisan may employ other suitable lock mechanisms 288 known in the art, as desired. Furthermore, it should be understood that one skilled in the art may scale the location of the lock mechanism, as desired. For example, the exercise system 200 can include a lock mechanism 289 disposed on a bottom or side portion of the central guide rail 174 while still remaining within the scope of the present disclosure.

In another example, as shown in FIG. 14, the exercise system 200 can include a spring loaded lock mechanism 460 configured to secure the upper body carriage 246 to the upper right carriage 176 and the upper left carriage 178. The spring loaded lock mechanism 460 is disposed on the upper body carriage 246 and includes a pair of pins 462, a pair of actuating posts 464 extending from the pair of pins 462, and a spring (not shown) disposed in a housing 466 and between the pair of pins 462. Each pin 462 among the pair of pins 462 extends from the housing 466 into a receiving hole 468 formed on each one of the upper right carriage 176 and the upper left carriage 178. The pair of actuating posts 464 extends upwards from the housing 466 and through the top side 256 of the upper body carriage 246 such that a portion protrudes from the top side 256. In operation, the user squeezes the pair of actuating posts 464 towards each other causing the pair of pins 462 to retract from the upper right carriage 176 and the upper left carriage 178 thereby disengaging the upper body carriage 246 from the upper right carriage 176 and the upper left carriage 178. When the pair of pins 462 to retract, force is applied to the spring located between the pair of pins 462 thereby deforming or compressing the spring. When the user releases the pair of actuating posts 464, the force acting on the spring is removed thereby causing the spring to return to it's normal length, which in turn pushes the pair of pins 462 outward.

With reference to FIGS. 11-14, the upper body carriage 246 includes an upper right carriage 176 configured to be slidingly attached to the right guide rail 170 and an upper left carriage 178 configured to be slidingly attached to the left guide rail 172. The upper right and left carriages 176, 178 are configured to translate in a reciprocating motion in the forward and rearward direction along the right and left guide rails 170, 172, as described above.

Referring to FIGS. 14 and 16, in one example, the right and left guide rails 170, 172 defines a linear tube or shaft 171 having a circular cross-section (FIG. 14). However, it should be appreciated that a skilled artisan may employ other suitable guides or track systems known in the art to slidingly attach the upper body carriage 246 to the right and left guide rails 170, 172, as desired. Non-limiting examples can include linear guide rails, double axis linear guide rails, tube tracks with rollers, v-grooved guides with rollers, U-shaped single or multiple groove tracks, linear bearing tracks, or any other guide known in the art.

Figure 12:
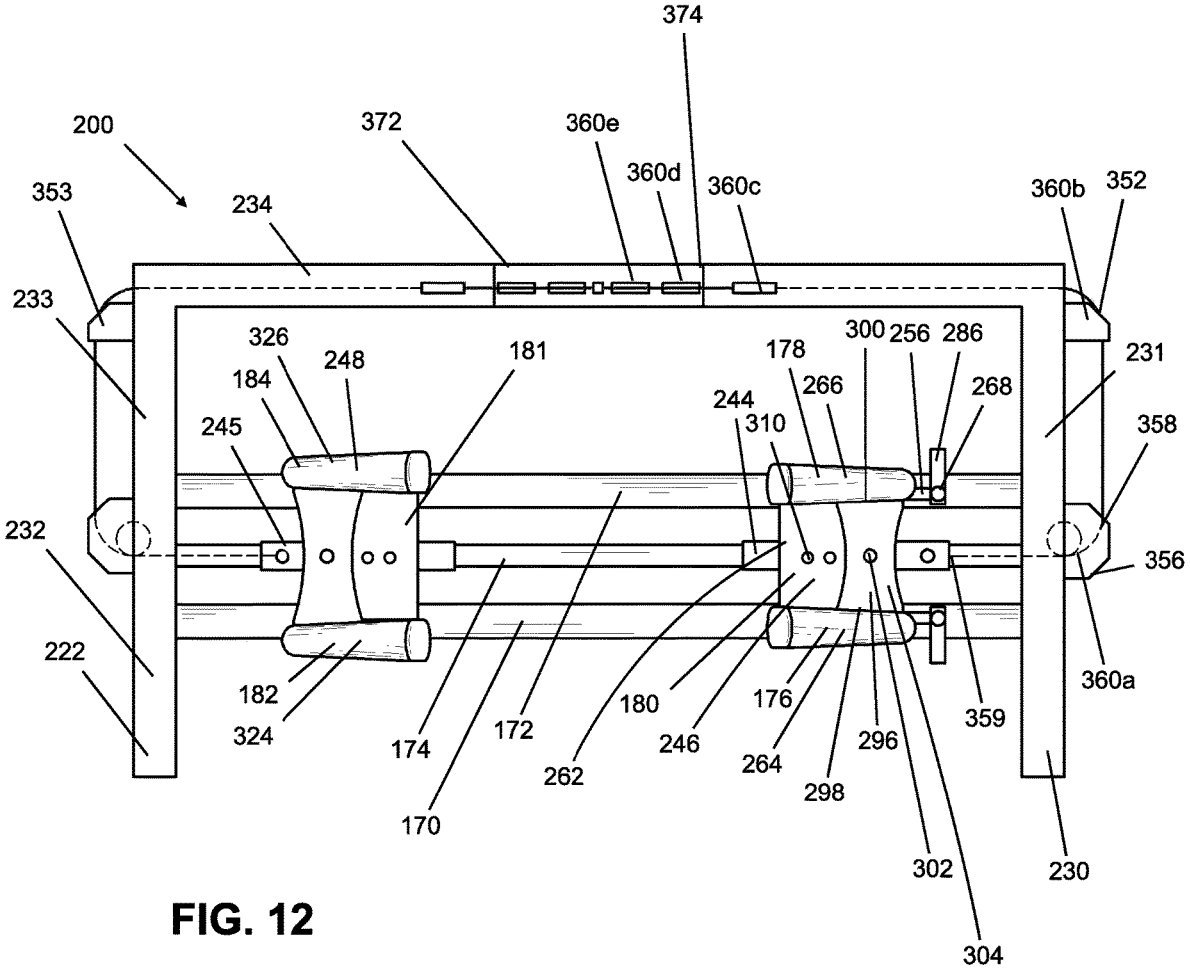
FIG. 12 is a top plan view of the exercise device of FIG. 9.

The upper body carriage 246 can include a lower right extremity support 264 secured to the upper right carriage 176 and a lower left extremity support 266 secured to the upper left carriage 178. In one example, the upper right carriage 176 can be secured to the upper left carriage 178 via an attachment plate 180 to facilitate simultaneous sliding of the upper right and left carriages 176, 178. Alternatively, the upper right carriage 176 can be detached from the upper left carriage 178 such that the upper right and left carriages 176, 178 can move independently from one another. As shown in FIG. 12, in one example, the lower right extremity support 264 can be secured on top of the upper body carriage 246 and the lower left extremity support 266 can be secured on top of the upper left carriage 178.

Figure 13:
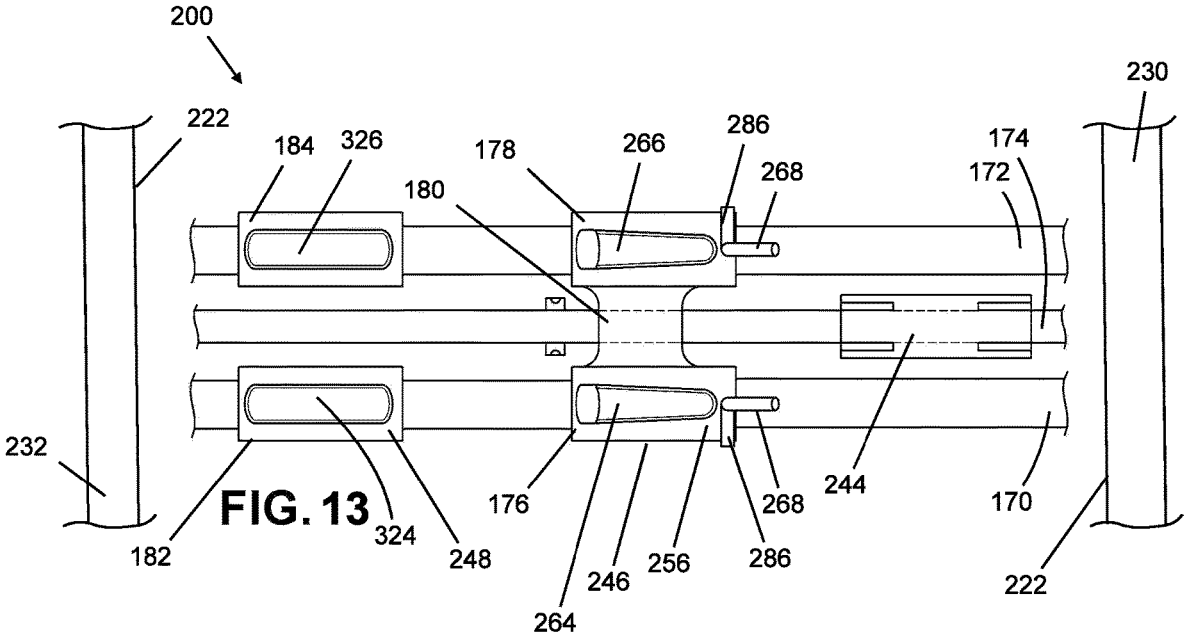
FIG. 13 is a top plan view of a track assembly including depicting a lower body carriage according to another embodiment of the present disclosure.

With continued reference to FIGS. 11-14, the upper body carriage 246 includes a pair of ergonomic vertical handles 268 having substantially the same features as the vertical handles 68 previously shown described. In one example, as best shown in FIG. 13, the pair of vertical handles 268 extend from the top side 256 of the upper body carriage 246. In another example, as best shown in FIG. 11, the pair of vertical handles 268 extend from the carriage 244.

The exercise system 200 can include a pair of horizontal handles 286 extending outwardly from the vertical handles 268 such that the pair of horizontal handles 286 are substantially parallel to the floor. Similar to the pair of vertical handles 268, the pair of horizontal handles 286 can extend from the top side 256 of the upper body carriage 246 (best shown in FIG. 13) or extend from a right side 334 and a left side 336 of the carriage 244 (best shown in FIG. 11). It should be appreciated that a skilled artisan may scale the location of the vertical handles 268 and horizontal handles 286, as desired. For example, the vertical handles 268 and horizontal handles 286 can be secured to and extending from a right side 258 and a left side 260 of the upper body carriage 246.

As shown in FIG. 12, in one example, the upper body carriage 246 can include a top support 296 similar to the top support 96 of FIGS. 6-7. The top support 296 can be slidingly attached to the upper body carriage 246 such that the top support 296 surrounds a portion of the upper body carriage 246. In this example, the pair of vertical handles 268 are attached to the upper right and left carriages 176, 178. The lower right and lower left extremity supports 264, 266 can be secured to the top support 296 to allow adjusting a distance between the pair of vertical handles 268 and the lower right and left extremity supports 264, 266 to accommodate varying arm lengths. More specifically, the lower right extremity support 264 can be attached to and extend from a right side 298 of the top support 296 and the lower left extremity support 266 can be attached to and extend from a left side 300 of the top support 296. The top support 296 can include a lock device 302 configured to secure the top support 296 to the upper body carriage 246. In one example, the lock device 302 is disposed on a top side 304 of the top support 296 and is identical to the lock mechanism 288 described in FIG. 14. As such, the upper body support 262 defines holes 310 configured to receive the lock device 302. In operation, the user slides the top support 296 to position the top support 296 to a predetermined location based on the length of the user's arms. Advantageously, the upper body support 262 can be adjusted to accommodate varying arm lengths of different users such that the arm of the user can comfortably rest on the upper body support 262 while gripping the vertical handles 268 or horizontal handles 286.

The lower body carriage 248 includes a lower right carriage 182, a lower left carriage 184, a right side support 324 secured on top of the lower right carriage 182, and a left side support 326 secured on top of the lower left carriage 184. Each one of the lower right carriage 182 and the lower left carriage 184 are configured to be slidingly engaged with the right guide rail 170 and the left guide rail 172, respectively, such that the lower right and left carriages 182, 184 can translate in a reciprocating motion in the forward direction and the rearward direction.

In one example, as best shown in FIG. 12, the lower right carriage 182 can be attached to the lower left carriage 184 via a lower body carriage attachment plate 181 to facilitate simultaneous sliding of the lower right and left carriages 182, 184.

In another example, as best shown in FIG. 13, the lower right carriage 182 and the lower left carriage 184 can be detached from one another thereby allowing the lower right carriage 182 and the lower left carriage 184 to move independently from one another. Advantageously, this allows the user more exercising options to choose from. For example, having the lower right and left carriages 182, 184 capable of sliding independent of one another permits the user to perform mountain climbers that target several different muscles, such as the core abdominal muscle group, shoulders, arms, and legs. To begin, the upper body carriage 246 is locked to the right guide rail 170 and the left guide rail 172, and the carriage 244 is locked to the central guide rail 174 via the lock mechanism 288. The lower right and left carriages 182, 184 can independently and freely translate back and forth about the right guide rail 170 and the left guide rail 172, respectively.

In the start position, the user can be in a high plank position in which the user places lower body extremities, such as the user's toes, on lower body support 122 and hands gripping the pair of horizontal handles 86. Once in the start position, the user bends the right knee and slides the lower right carriage 182 via the lower body extremities in the forward direction toward the upper body carriage 246 such that the knees slide toward the chest. As the user slides the lower right carriage 182 in the rearward direction, the user simultaneously bends the left knee and slides the lower left carriage 184 in the forward direction. As the user slides the lower left carriage 184 back in the rearward direction, the user simultaneously bends the right knee and slides the lower right carriage 182 in the forward direction, and so on. The user repeats as desired.

Figure 15:
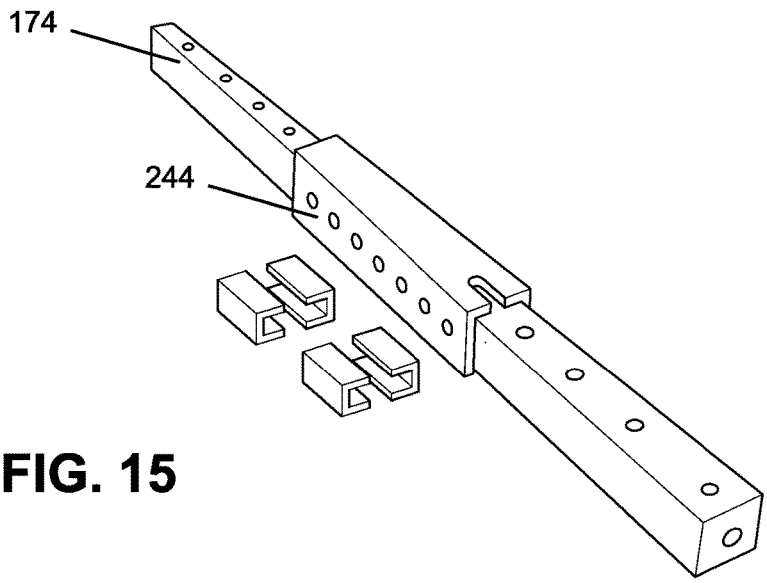
FIG. 15 is a perspective view of a carriage disposed on a central guide rail according to the present disclosure.

With continued reference to FIGS. 11-15 the carriage 244 is slidingly attached to the central guide rail 174 and configured to translate in a reciprocating motion in the forward and rearward direction. As best shown in FIG. 15, in a non-limiting example, the central guide rail 174 can define a rectangular tube and the carriage 244 can include a square sleeve bearing carriage mounted on the central guide rail 174. However, it should be appreciated that a skilled artisan may scale the shape of the central guide rail 174, as desired.

In one example, the carriage 244 is configured to engage with the upper body carriage 246 such that the carriage 244 and upper body carriage 246 simultaneously translate between the forward direction and rearward direction. When the upper body carriage 246 and carriage 244 are locked together, the attachment plate 180 covers a portion of a top side 332 of the carriage 244. In one example, the upper body carriage 246 and carriage 244 are locked together via a lock mechanism 288, wherein the post 290, pin 291, and knob 292 are disposed on the upper body carriage 246 and the carriage 244 defines lock holes 294 configured to receive the post 290. In operation, the user pulls the pin 291 up via the knob 292, slides the upper body carriage 246 to align the pin 291 with the lock hole 294 corresponding to the desired location, and releases the knob 292 causing the pin 291 to pass into the lock hole 294 thereby locking the upper body carriage 246 in place.

Referring back to FIG. 11, the resistance assembly 226 is configured to apply a predetermined level of resistive force to at least one of the carriage 244, an upper body carriage 246, and a lower body carriage 248. In the example shown in FIG. 11, the resistance assembly 226 is identical to the resistance assembly 26 shown and described in FIG. 1. As such, the components and features of the resistance assembly 26 of FIG. 1 apply to the resistance assembly 226 shown in FIG. 11.

With reference to FIGS. 11-12, the exercise system 200 can include a connecting mechanism 352 disposed on a right side 231 of the frame 222 and configured to mechanically couple the carriage 244 to the resistance assembly 226. In one example, the connecting mechanism 352 can be disposed on a left side 233 of the frame 222. In another example, the exercise system 200 can include a connecting mechanism 352 disposed on the right side 231 of the frame 222 and a connecting mechanism 352 disposed on the left side 233.

In one example, the connecting mechanism 352 can include a cable and pulley system 356. The cable and pulley system 356 includes a cable 358 and a plurality of pulleys 360. The cable 358 includes a first end 359 affixed to the carriage 244 and a second end 361 affixed to a lift member 362 (FIG. 11), which in turn, is connected to an upper most weight plate 346. The cable 358 extends from the carriage 244 towards the first side member 230 of the frame 222, around a 1st pulley 360*a* located at the first side member 230 of the frame 222, and around a 2nd pulley 360*b* located at a back end of the first side member 230. The cable 358 extends from the 2nd pulley 360*b* and runs over a 3rd pulley 360*c* located on a backend member 234 of the frame 222 proximate a vertical member 238, extends upward along the vertical member 238 towards the top 372, runs over a 4th pulley 360*d* located proximate a top right corner 374 of the vertical member 238, and runs over a 5th pulley 360*e*. The cable 158 extends from the 5th pulley 360*e* downward towards a weight stack 344 where the cable 158 is secured to the lift member 362, which in turn, is connected to the upper most weight plate 346.

In operation, with the upper body carriage 246 secured to the carriage 244, the user exerts force on the upper body carriage 246, which is translated through the cable 358 and to the weight stack 344 thereby exerting resistance against the rearward movement of the carriage 244. In other words, as the user slides the upper body carriage 246 in the rearward direction, the force applied to the upper body carriage 246 and thus the carriage 244 is transmitted through the cable 358, rotating the plurality of pulleys 360 such that the force transmitted to the cable 358 acts on the lift member 362 attached to the weight stack 344 thereby lifting the selected number of weight plates 346.

As shown in FIG. 12, the exercise system 200 can include a second carriage 245 substantially similar to the carriage 244. However, the second carriage 245 is configured to engage with the lower body carriage 248. Likewise, the second carriage 245 is configured to engage with the lower body carriage 248 such that the carriage 245 and lower body carriage 248 simultaneously translate between the forward direction and rearward direction, which is described in detail above in relation to the carriage 244 and the upper body carriage 246. As such, the exercise system 200 can further include a second connecting mechanism 353 substantially similar to the connecting mechanism 352 in that the second connecting mechanism 353 is configured to mechanically couple the second carriage 245 to the resistance assembly 226. However, the second connection mechanism 353 is disposed on a left side 233 of the frame 222.

Figure 17:
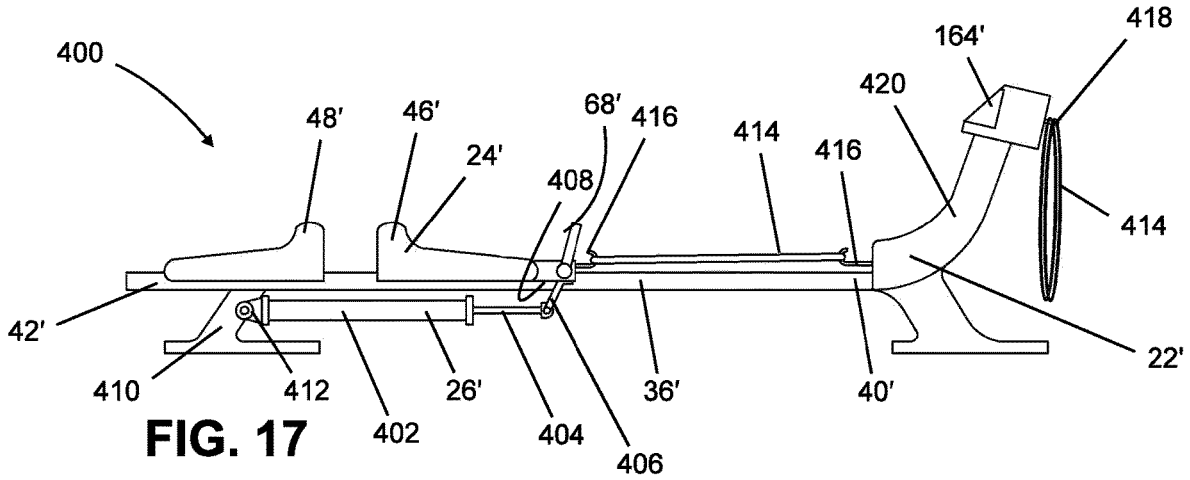
FIG. 17 is a side elevation view of an exercise device according to another embodiment of the present disclosure.

Referring to FIG. 17, an exercise system 400, according to another embodiment is shown. The exercise system 400 generally includes similar components as the exercise system 20 shown in FIGS. 1-8. Thus, for simplicity, in FIG. 17, like or related structure to that shown in FIGS. 1-8 is identified with the same reference number and a prime symbol (') for purposes of clarity.

The exercise system 400 includes a frame 22' including a guide rail 36', an upper body carriage 46', a lower body carriage 48', and a resistance assembly 26' configured to apply a predetermined level of resistive force to at least one of the upper body carriage 46' and the lower body carriage 48'. Each one of the upper body carriage 46' and the lower body carriage 48' are configured to be slidingly engaged with the guide rail 36' to translate a reciprocating motion in the forward direction and the rearward direction with respect to a first end 40' and a second end 42' of the guide rail 36'.

In one example, the resistance assembly 26' includes a cylinder 402, a piston rod 404 extending outwardly from the cylinder 402, a piston (not shown) disposed in the cylinder 402 and connected to the piston rod 404, and an actuation member 406 configured to be attached to the piston rod 404. The piston is configured to move up or down within the cylinder 402 causing hydraulic fluid to flow between chambers formed in the cylinder 402 thereby causing resistive pressure. In the example shown in FIG. 17, the resistance assembly 26' is configured to be attached to the upper body carriage 46' and apply resistive force to the upper body carriage 46'. More specifically, the actuation member 406 is attached to a bottom side 408 of the upper body carriage 46' and the opposing end of the resistance assembly 26' is attached to a rear leg 410 of the exercise system 400 via an attachment device 412.

In operation, the user is positioned on the exercise system 400, for example, wherein the knees are supported on the lower body carriage 48', the forearms are supported on the upper body carriage 46' and the hands are gripping vertical handles 68' such that the user is face down in a traditional low plank position. The user exerts force on the upper body carriage 46' to slide the upper body carriage 46' in the rearward direction (e.g., towards the second end 42') causing the actuation member 406 to engage the resistance assembly 26' to resist the rearward motion. Specifically, as the actuation member 406 moves in the rearward direction with the upper body carriage 46', the actuation member 406, pushing on the piston rod 404 pushes the piston into the cylinder thereby providing positive resistance against the rearward movement of the upper body carriage 46'.

It should be appreciated that one skilled artisan may scale the location of the resistance assembly 26', as desired. For example, it should be understood that the resistance assembly 26' is not limited to being attached to the upper body carriage 46' and rear leg 410 of the exercise system 400 and that one skilled in the art may attach the resistance assembly 26' elsewhere, such as to the lower body carriage 48' and frame 22' to permit the user to perform exercises that require the lower body carriage 48' to translate in the forward and rearward direction. It should be appreciated that one skilled in the art may attach the resistance assembly 26' to the lower body carriage 48' and the upper body carriage 46' to permit the user to perform exercises that require both the lower body carriage 48' and the upper body carriage 46' to translate in the forward and rearward direction.

With continued reference to FIG. 17, in another example, the resistance assembly 26' includes a resistance band 414 and attachment system 416 configured to attach the resistance band 414 to the exercise system 400. The resistance band 414 can be formed by an elastic material, such as rubber, having a high degree of elasticity. The resistance band 414 includes a cutout middle section forming a continuous band. The resistance bank 414 can have varying thicknesses which determines the level of elastic force generated when the resistance band 414 is stretched. The shape and thickness of the resistance band 414 can vary based on the user. In the example shown in FIG. 17, the attachment system 416 includes a pair of hooks, wherein one hook is affixed to a front portion 420 of the frame 22' and one hook is affixed to the upper body carriage 46'. The resistance band 414 is secured around the pair of hooks such that when the upper body carriage 46' translates in the rearward direction, the resistance band 414 is stretched causing the resistance band 414 to exert resistance against the rearward movement of the upper body carriage 46'. In one example, the exercise system 400 includes a footrest proximate the second end 42'.

It should be appreciated that one skilled artisan may select other suitable methods of attaching the resistance band 414, as desired.

As shown in FIG. 17, the exercise system 400 can include a display 164' or display support 166' as previously described. In one example, the exercise system 400 includes a storage device 418 configured to receive and hold the resistance band 414 when not in use. In this example, the storage device 418 is located on a backside of the frame 22'.

Figure 18:
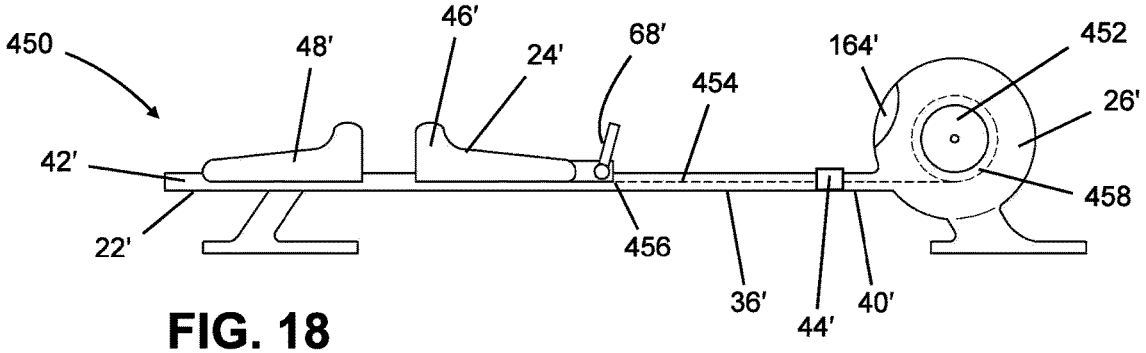
FIG. 18 is a side elevation view of an exercise device according to another embodiment of the present disclosure.
Figure 19:
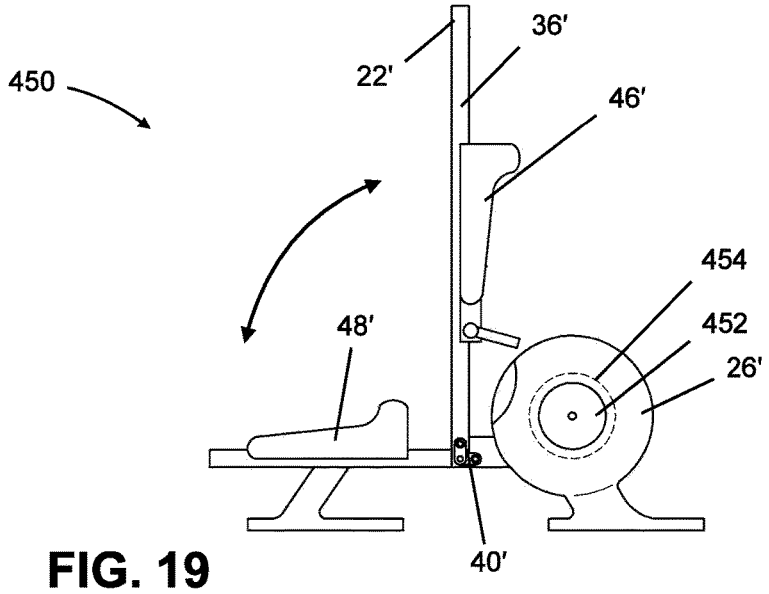
FIG. 19 is a side elevation view of the exercise device of FIG. 12, depicting the exercise device in a storage position.

Referring to FIGS. 18-19, in another embodiment, an exercise system 450 is shown that generally includes similar components as the exercise system 20 shown in FIGS. 1-8. Thus, for simplicity, in FIGS. 18-19, like or related structure to that shown in FIGS. 1-8 is identified with the same reference number and a prime symbol (') for purposes of clarity.

The exercise system 450 includes a frame 22' including a guide rail 36', an upper body carriage 46', a lower body carriage 48', and a resistance assembly 26' configured to apply a predetermined level of resistive force to at least one of the upper body carriage 46' and the lower body carriage 48'. Each one of the upper body carriage 46' and the lower body carriage 48' are configured to be slidingly engaged with the guide rail 36' to translate a reciprocating motion in the forward direction and the rearward direction with respect to a first end 40' and a second end 42' of the guide rail 36'. In one example, the exercise system 450 can include a carriage 44' as described in detail above.

In one example, the resistance assembly 26' includes a flywheel 452 with a resistance mechanism (not shown), such as a magnetic brake/resistor, a water resistor, or fan, configured to resist force exerted by the user. The flywheel 452 is rotatably coupled to the frame 22' and mechanically coupled to the upper body carriage 46' via a connecting device 454. In one example, the connecting device 454 can include a cord, cable, or a chain. As shown in FIG. 18, the connecting device 454 is attached to the upper body carriage 46' at a first end 456 and the flywheel 452 at a second end 458.

In operation, the user is positioned on the exercise system 450, for example, wherein the knees are supported on the lower body carriage 48', the forearms are supported on the upper body carriage 46' and the hands are gripping vertical handles 68' such that the user is face down in a traditional low plank position. The user exerts force on the upper body carriage 46' to slide the upper body carriage 46' in the rearward direction (e.g., towards the second end 42') thereby pulling the attached connecting device 454 (e.g., cable). A force transferring device (not shown) is provided that is configured to mechanically connect the lower body carriage 48' and flywheel 452 such that the force exerted by the user, by sliding the upper body carriage 46' in the rearward direction, applies torque to the flywheel 452 causing the flywheel 452 to rotate.

As shown in FIGS. 18-19, the exercise system 450 can include a display 164' or display support 166' as previously described.

As shown in FIG. 19, in one example, the exercise system 450 is configured to fold into a storage position in order to open up space when the exercise system 450 is not being used.

Figure 20:
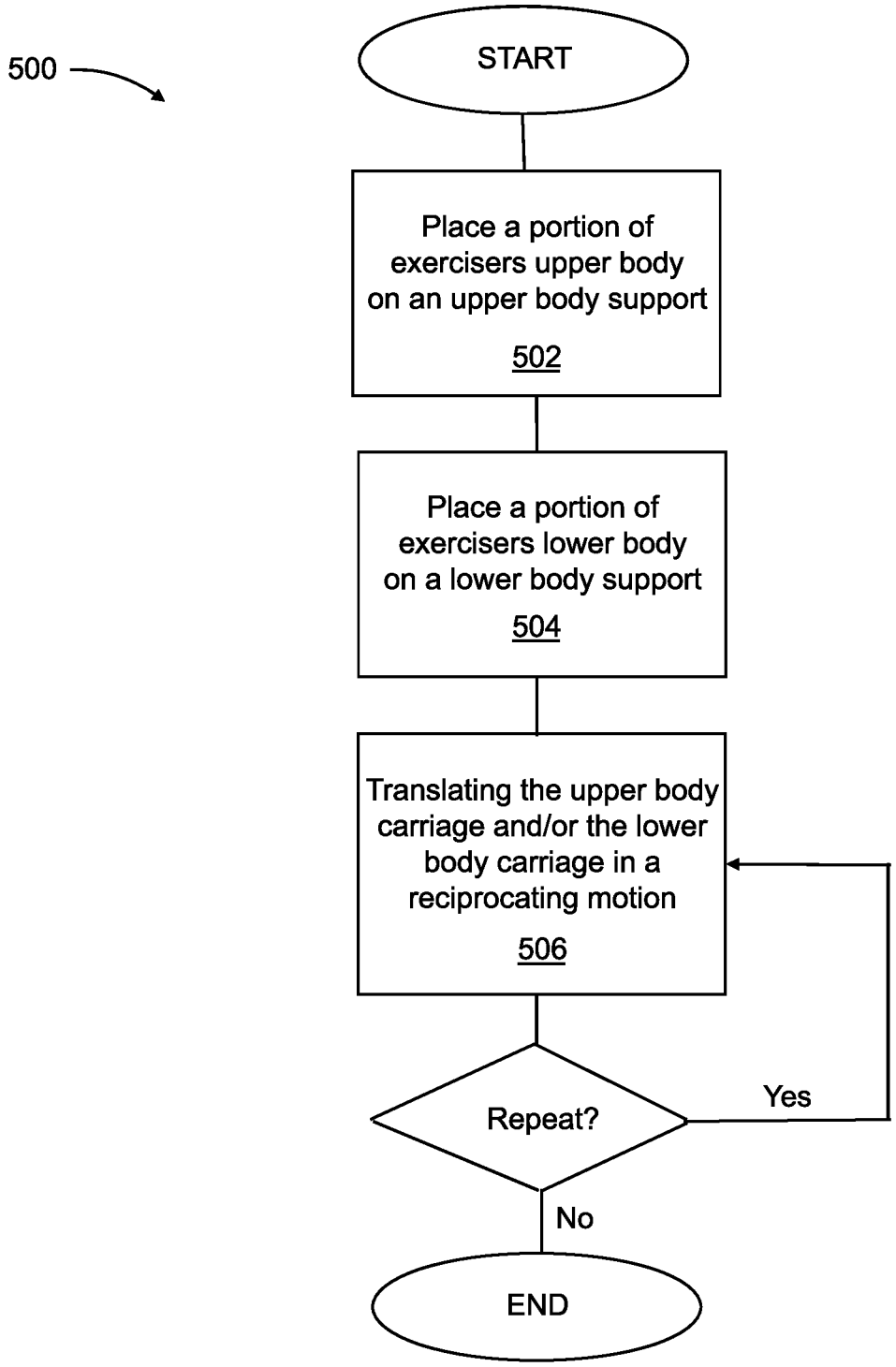
FIG. 20 is a flow chart illustrating a method of performing an exercise that targets multiple muscle groups according to the present disclosure.

Referring to FIG. 20, a method 500 of performing an exercise that targets a plurality of muscle groups of an exercisers is shown. For example, the plurality of muscle groups can be selected from the group consisting of abdominal muscles, deltoid/shoulder muscles, triceps muscles, latissimus dorsi muscles, quadricep muscles, pectoralis muscles, gluteal muscles, biceps, and forearms. At step 502, a portion of the exercisers upper body is placed on a surface of the upper body support 62, 262 such that a right elbow is aligned with and beneath a right shoulder and a left elbow is aligned with and beneath a left shoulder. In one example, the portion of the upper body includes a portion of the right arm such as the right forearm and a portion of the left arm such as the left forearm.

At step 504, a portion of the exercisers lower body is placed on a surface of the lower body support 122, 324, 326. Once a portion of the exercisers upper body and lower body are positioned on the upper body support 62, 262 and the lower body support 122, 324, 326, the exerciser is positioned face down with a flat back drawing obliques in and the navel towards the spine.

At step 506, the exerciser can move the upper body back and forth via the upper body carriage 46, 246 by exerting force on the upper body support 62, 262 thereby translating the upper body carriage 46, 246 in a reciprocating motion between the forward direction and the rearward direction such that the plurality of muscle groups are activated. Alternatively, the exerciser can move the lower body back and forth via the lower body carriage 48, 248 by exerting force on the lower body support 122, 324, 326 thereby translating the lower body carriage 48, 248 in a reciprocating motion between the forward direction and the rearward direction such that the plurality of muscle groups are activated. In a further example, the exerciser can move both the upper body carriage 46, 246 and the lower body carriage 48, 248 simultaneously depending on the exercise being performed. Next, the exerciser can repeat the translating step or end the exercise after a predetermined duration or until the exerciser experiences muscle fatigue causing the exerciser to stop.

The method can include providing a frame including a guide rail having a first end and a second end, providing an upper body carriage and a lower body carriage, each one of the upper body carriage and the lower body carriage configured to be slidingly engaged with the guide rail to translate in a reciprocating motion relative to the first end and the second end of the guide rail, and providing an upper body support secured to the upper body carriage and a lower body support secured to the lower body carriage. The upper body support can define the upper body support surface and the lower body support can define the lower body support surface. The method can further include providing a resistance assembly attached to the frame and providing a connecting mechanism configured to mechanically couple at least one of the upper body carriage and the lower body carriage to the resistance assembly such that the resistance assembly applies a predetermined level of resistive force to at least one of the upper body carriage and the lower body carriage. A portion of the upper body is placed on the upper body support surface of the upper body carriage and the portion of the lower body is placed on the lower body support surface of the lower body carriage. The portion of the upper body translates in a reciprocating motion between the forward direction and the rearward direction via the upper body carriage and the portion of the lower body translates in a reciprocating motion between the forward direction and the rearward direction via the lower body carriage. The method can further include gripping a pair of vertical handles or a pair of horizontal handles.

Advantageously, the exerciser can perform a wide range of exercises that incorporate resistance while maintaining proper form thereby permitting the exerciser to activate greater number of muscle groups such as the abdominal muscles, deltoid/shoulder muscles, triceps muscles, latissimus dorsi muscles, quadricep muscles, pectoralis muscles, gluteal muscles, biceps, and forearms.

While certain representative embodiments and details have been shown for purposes of illustrating the present disclosure, it will be apparent to those skilled in the art that various changes may be made without departing from the scope of the disclosure, which is further described in the following appended claims.

What is claimed is:

1. An exercise system, comprising:

a frame including a right guide rail, a left guide rail, and a central guide rail configured to be disposed between the right guide rail and the left guide rail;

an upper body carriage including an upper right carriage configured to be slidingly attached to the right guide rail and an upper left carriage configured to be slidingly attached to the left guide rail;

a lower body carriage including a lower right carriage configured to be slidingly attached to the right guide rail and a lower left carriage configured to be slidingly attached to the left guide rail;

a carriage configured to be slidingly attached to the central guide rail;

a resistance assembly attached to the frame; and a connecting mechanism configured to mechanically couple at least one of the upper body carriage, the lower body carriage, and the carriage to the resistance assembly such that the resistance assembly applies a predetermined level of resistive force to at least one of the upper body carriage, the lower body carriage, and the carriage.

2. The exercise system of claim 1, wherein the upper body carriage and the carriage are configured to lock together such that the upper body carriage and the carriage simultaneously translate between a forward direction and a rearward direction.

3. The exercise system of claim 1, wherein the lower body carriage and the carriage are configured to lock together such that the lower body carriage and the carriage simultaneously translate between a forward direction and a rearward direction.

4. The exercise system of claim 1, wherein the upper body carriage includes an attachment plate configured to attach the upper right carriage to the upper left carriage.

5. The exercise system of claim 1, wherein the lower body carriage includes an attachment plate configured to attach the lower right carriage to the lower left carriage.

6. The exercise system of claim 1, wherein the upper body carriage includes a pair of vertical handles and a pair of horizontal handles.

7. The exercise system of claim 1, wherein the upper body carriage includes a lower right extremity support secured to the upper right carriage and a lower left extremity support secured to the upper left carriage, and the lower body carriage includes a right extremity support secured to the lower right carriage and a left extremity support secured to the lower left carriage.

8. The exercise system of claim 1, wherein the frame includes a vertical member and the resistance assembly is attached to the vertical member.

9. The exercise system of claim 1 further comprising a top support disposed on the upper body carriage, wherein the upper right carriage and the upper left carriage are attached to the top support.

10. The exercise system of claim 1, wherein the resistance assembly includes a weight stack.

11. The exercise system of claim 1, wherein the upper body carriage includes a lower right extremity support pivotably secured to the upper right carriage and a lower left extremity support pivotably secured to the upper left carriage.

* * * * *